US011304575B2

(12) United States Patent
Dorra

(10) Patent No.: US 11,304,575 B2
(45) Date of Patent: Apr. 19, 2022

(54) AUTO CLEANING TOILET SEAT ASSEMBLY

(71) Applicant: Auto Cleaning Toilet Seat USA, LLC, Sunny Isles Beach, FL (US)

(72) Inventor: Maximo Dorra, North Miami Beach, FL (US)

(73) Assignee: Auto Cleaning Toilet Seat USA, LLC, North Miami Beach, FL (US)

( * ) Notice: Subject to any disclaimer, the term of this patent is extended or adjusted under 35 U.S.C. 154(b) by 425 days.

(21) Appl. No.: 16/486,619

(22) PCT Filed: Jul. 26, 2019

(86) PCT No.: PCT/US2019/043725
§ 371 (c)(1),
(2) Date: Aug. 16, 2019

(87) PCT Pub. No.: WO2021/021088
PCT Pub. Date: Feb. 4, 2021

(65) Prior Publication Data

US 2021/0353116 A1 Nov. 18, 2021

Related U.S. Application Data

(63) Continuation-in-part of application No. PCT/US2017/062606, filed on Nov. 20, 2017, which (Continued)

(51) Int. Cl.

| | |
|---|---|
| ***A47K 13/30*** | (2006.01) |
| ***E03D 9/00*** | (2006.01) |
| ***E03D 9/05*** | (2006.01) |

(52) U.S. Cl.
CPC ..... *A47K 13/302* (2013.01); *E03D 9/005* (2013.01); *E03D 9/05* (2013.01)

(58) Field of Classification Search
CPC .. A47K 13/302; A47K 13/305; A47K 13/307; E03D 9/005; E03D 9/05; E03D 9/04
See application file for complete search history.

(56) References Cited

U.S. PATENT DOCUMENTS

| | | | | |
|---|---|---|---|---|
| 4,924,532 A * | 5/1990 | Pennestri | ..... | A47K 13/302 4/222 |
| 8,060,953 B1 | 11/2011 | Dorra | | |
| 8,776,278 B1 * | 7/2014 | Dorra | ..... | A47K 13/302 4/233 |

FOREIGN PATENT DOCUMENTS

| | | |
|---|---|---|
| WO | 2018/156190 A1 | 8/2018 |
| WO | 2018/156227 A2 | 8/2018 |

* cited by examiner

*Primary Examiner* — Janie M Loeppke
(74) *Attorney, Agent, or Firm* — Weisun Rao; Jun Chen; Venture Partner, LLC

(57) ABSTRACT

An auto cleaning toilet seat assembly with a cover coupled to a toilet seat and defining a fluid transport conduit surrounding the toilet seat. The cover also includes an air deflector formed as part of the upper wall and at the front end of the cover, wherein the air deflector includes two opposing surfaces converging together away from the inner surface of the outer sidewall. The assembly is operably to emit a liquid on a rear portion of a toilet seat and induce a gas to transport that liquid from the rear of the toilet seat to the front of the toilet, whereby the air deflector directs the liquid and air through the fluid transport conduit and into a toilet bowl utilizing the two opposing surfaces of the air deflector.

19 Claims, 27 Drawing Sheets

Related U.S. Application Data is a continuation-in-part of application No. PCT/US2017/037519, filed on Jun. 14, 2017.

(60) Provisional application No. 62/462,031, filed on Feb. 22, 2017.

100

1100

AUTO CLEANING TOILET SEAT ASSEMBLY

CROSS-REFERENCE TO RELATED APPLICATIONS

This application is a continuation-in-part of and claims priority to PCT Application No. PCT/US2017/062606, filed on Nov. 20, 2017, which is a continuation-in-part of and claims priority to PCT Application No. PCT/US2017/037519, filed on Jun. 14, 2017, which claims priority to U.S. Provisional Application No. 62/462,031 filed on Feb. 22, 2017, the contents of all of which are incorporated herein by reference in their entirety.

FIELD OF THE INVENTION

The present invention relates to toilet seat cleaning systems, and more particularly, to an assembly for automatically cleaning a top surface of a toilet seat.

BACKGROUND OF THE INVENTION

There are many other known toilet seat washing assemblies. Most of these assemblies employ the use of numerous components in order to function properly. These numerous components require a great deal of user time spent in maintenance and installation. Moreover, many of these assemblies have components that rotate and move when in operation such that they are more susceptible to failure. Not only are these assemblies more susceptible to failure, they are also more expensive and difficult to manipulate for precise control of the assembly during the cleaning process. For example, some known assemblies have rotating arms that clean the toilet seat but these arms are not able to be controlled or optimized to produce various cleaning cycles desirable for a particular user. The use of additional components by these known assemblies also make them generally expensive for most users and/or other consumers, and require more time/cost to install and to maintain.

Additionally, many known toilet seat cleaning assemblies are not capable of, or are not configured properly to, effectively and efficiently clean and/or sanitize toilet seats that are completely circular. Specifically, some known toilet seat cleaning assemblies are designed to sequential emit a cleaning solution around a toilet seat that is then designed to run off into the toilet bowl. These systems, however, often leave residue from the cleaning solution and/or require the emission of significant amounts of fluid. As such, the toilet seat is disadvantageously not immediately ready for use by the user and/or is not economical. Additionally, many known toilet seat cleaning assemblies are designed to work solely with u-shaped toilet seats, thereby making said assemblies ineffective or impracticable for use with circular toilet seats.

SUMMARY OF THE INVENTION

The invention provides an auto cleaning toilet seat assembly that overcomes the above-mentioned disadvantages of the known devices and methods of this general type. The invention provides an effective and efficient assembly and method to clean and/or sanitize a toilet seat. Specifically, with the foregoing and other objects in view, there is provided, in accordance with the invention and in combination with a toilet having a toilet bowl and a toilet seat coupled to the toilet bowl, wherein the toilet seat defines a center aperture and including a front end defining a distal spatial discontinuity, a back end, a top surface, an inner circumferential surface, and an outer circumferential surface, an improvement associated therewith. The improvement comprises a cover with an inner surface and an outer surface opposing the inner surface. The cover includes a back end, a front end, an upper wall flanked by an outer sidewall and an inner sidewall, wherein both the outer and inner sidewalls oppose one another, extend downwardly from the upper wall, and have inner surfaces defining a fluid transport conduit. The cover includes an air deflector defining a portion of the upper wall of the cover and disposed proximal to the front end of the cover. The air deflector includes two opposing surfaces converging together and extending downwardly away from the upper wall of the cover. The cover also includes a first position and a second position along a cover translation path, wherein the first position includes the cover surrounding the toilet seat, the inner surface of the outer sidewall continuously contouring the outer circumference surface of the toilet seat from the back end of the toilet seat and toward the front end of the toilet seat, the inner surface of the inner sidewall continuously contouring the inner circumference surface of the toilet seat from the back end of the toilet seat toward the front end of the toilet seat, and with the two opposing surfaces of the air deflector converging in an orientation toward the distal spatial discontinuity disposed at the front end of the toilet seat. The cover also defines at least one liquid aperture fluidly coupled to the fluid transport conduit and at least one gas aperture fluidly coupled to the fluid transport conduit, wherein the fluid transport conduit, when the cover is in the first position, spans from the back end of the toilet seat, to the front end of the toilet seat, and terminate at the distal spatial discontinuity disposed at the front end of the toilet seat. The improvement also includes the cover assembly having an electrical system operably configured, when the cover is in the first position, to cause a liquid matter, from a liquid source, to discharge, through the at least one liquid aperture, onto a portion of the top surface of the toilet seat and cause an induced flow of gaseous matter, from a gas source, to discharge, through the at least one gas aperture, at a speed sufficient to transport the liquid matter through the fluid transport conduit, on the top surface of toilet seat, and through the distal spatial discontinuity disposed at the front end of the toilet seat.

Also in accordance with the invention, the toilet seat cleaning assembly has a cover with an inner surface and an outer surface opposing the inner surface, wherein the cover includes a back end, a front end, an upper wall flanked by an outer sidewall operably configured to contour an outer circumference surface of a toilet seat and an inner sidewall operably configured to contour an inner circumference surface of the toilet seat, both the outer and inner sidewalls opposing one another, extending downwardly from the upper wall, and having inner surfaces defining a fluid transport conduit. The cover also includes an air deflector defining a portion of the upper wall of the cover and disposed proximal to the front end of the cover, wherein the air deflector includes two opposing surfaces converging together and extending downwardly away from the upper wall of the cover and spanning from the outer sidewall to the inner sidewall in a longitudinal direction to define an air deflector length and wherein the two opposing surfaces of the air deflector converge to a common end point disposed a uniform distance from the upper wall along the air deflector length. The cover may also define at least one liquid aperture fluidly coupled to the fluid transport conduit and define at least one gas aperture fluidly coupled to the fluid transport conduit spanning from the back end of the cover to the front end of the cover.

The toilet seat provided by this invention may include a device that contains and emits on demand a cleaning solution for cleaning the toilet. This cleaning solution-emitting device can be placed or located virtually anywhere in or on the toilet seat, e.g., behind the toilet, on left or right side of the toilet, inside the toilet, outside the toilet, or inside the cavity of the toilet seat. In addition, the cleaning solution-emitting device may be outside the toilet and is capable of providing such cleaning solution to several auto cleaning toilet seats of this invention either together and separately as needed.

Although the invention is illustrated and described herein as embodied in an auto cleaning toilet seat assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the toilet seat spanning from the rear of the toilet seat to the front of the toilet seat. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION

Figure 1:
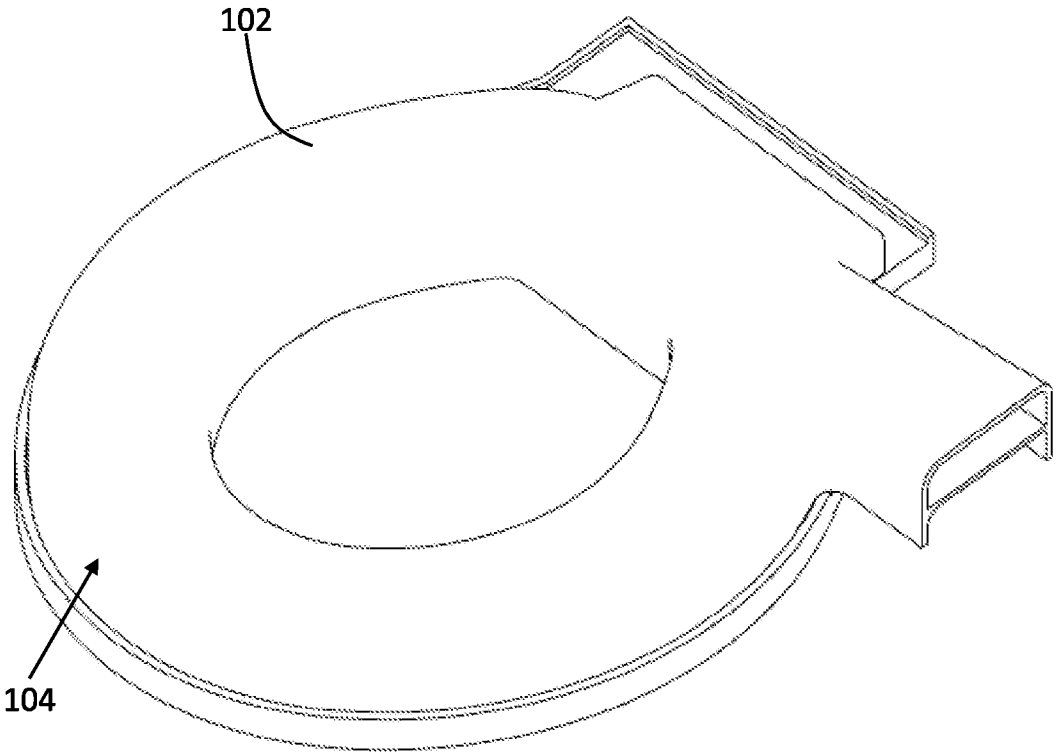
FIG. 1 is an isometric and fragmentary view of a toilet seat cover assembly with the cover in a closed position in accordance with one embodiment of the present invention.

It is evident that an invention such as the automatic toilet seat-cleaning system claimed in the present application is quite desirable because it disinfects the toilet seat before use. In addition, the claimed invention can be used with circular and/or oval shape toilet bowls, having discontinuities or otherwise, to effectively clean and/or disinfect the top surface of said toilet seat. The present invention also accomplishes the cleaning and/or disinfecting effectiveness utilizing minimal parts and energy.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 2:
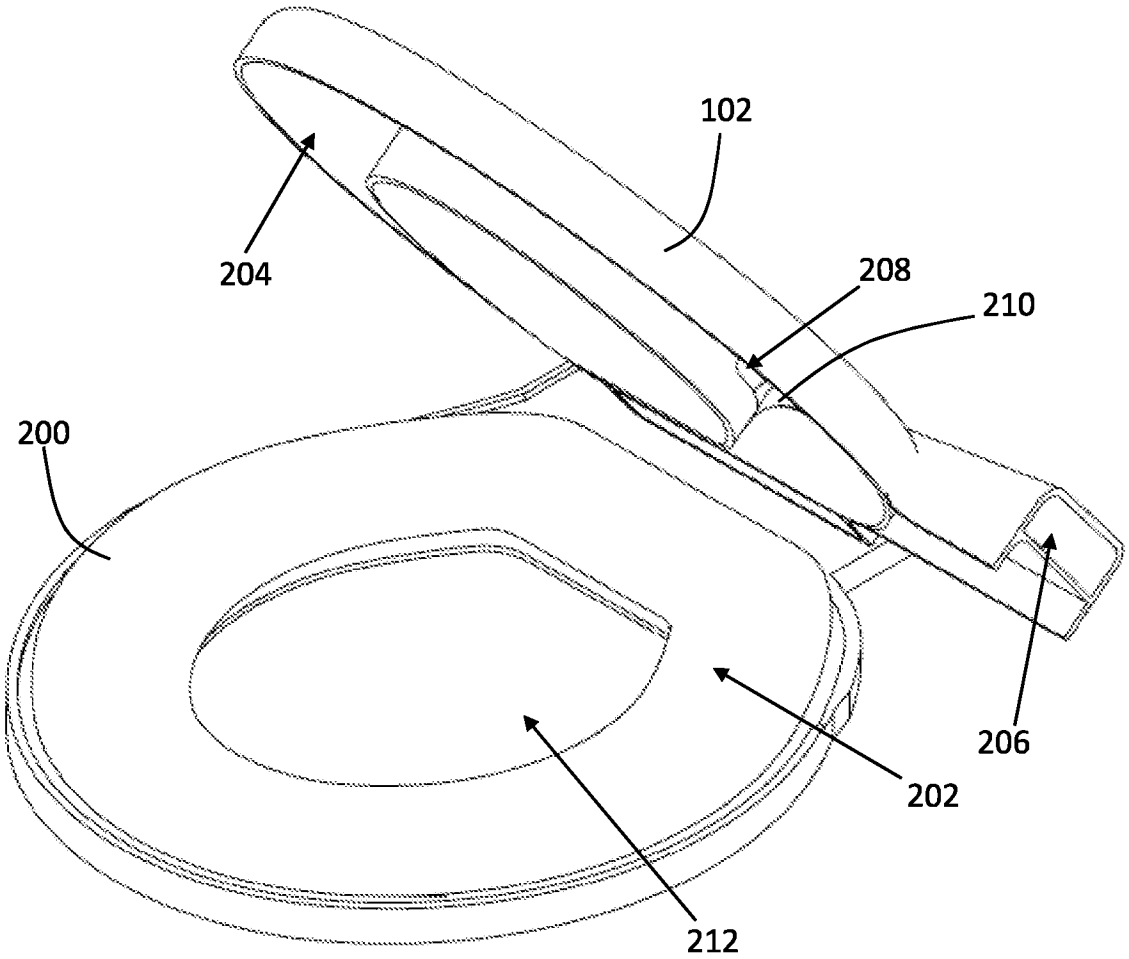
FIG. 2 is an isometric and fragmentary view of a cover assembly of FIG. 1 in an open position.
Figure 3:
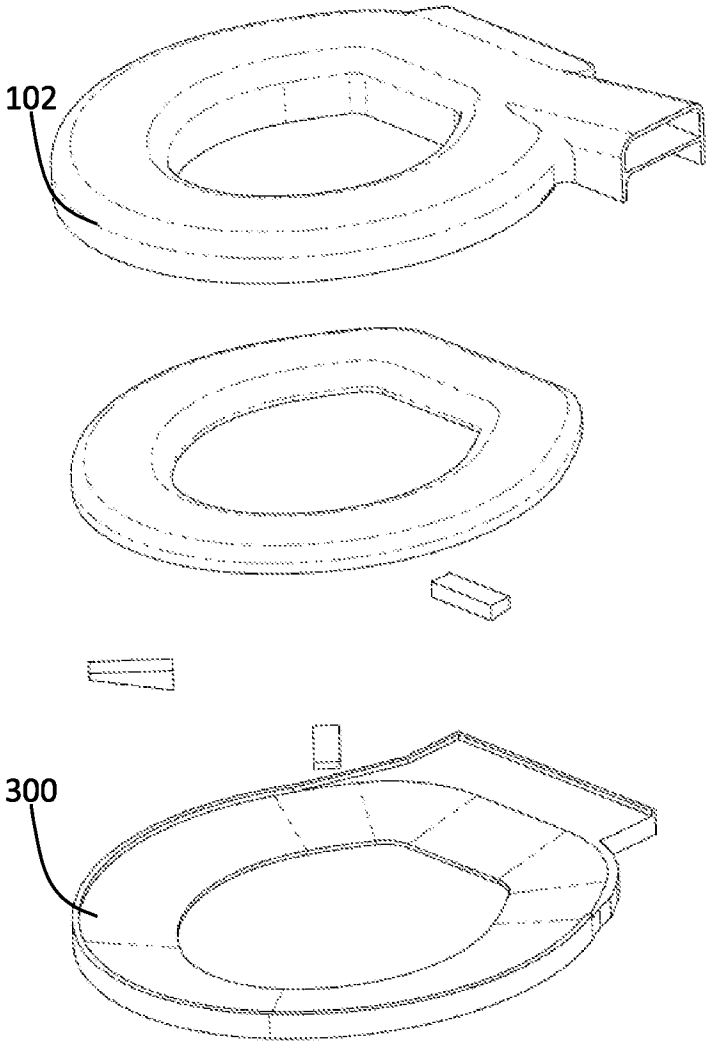
FIG. 3 is an exploded view of the cover assembly of FIG. 1.
Figure 4:
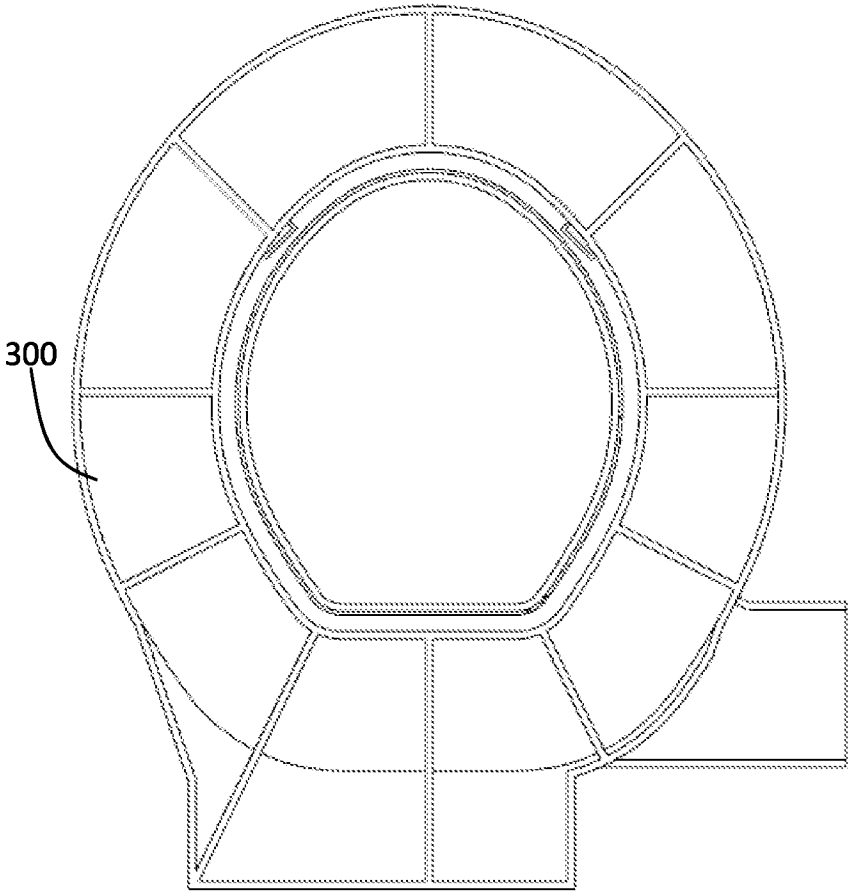
FIG. 4 is a bottom plan view of the cover assembly of FIG. 1.
Figure 7:
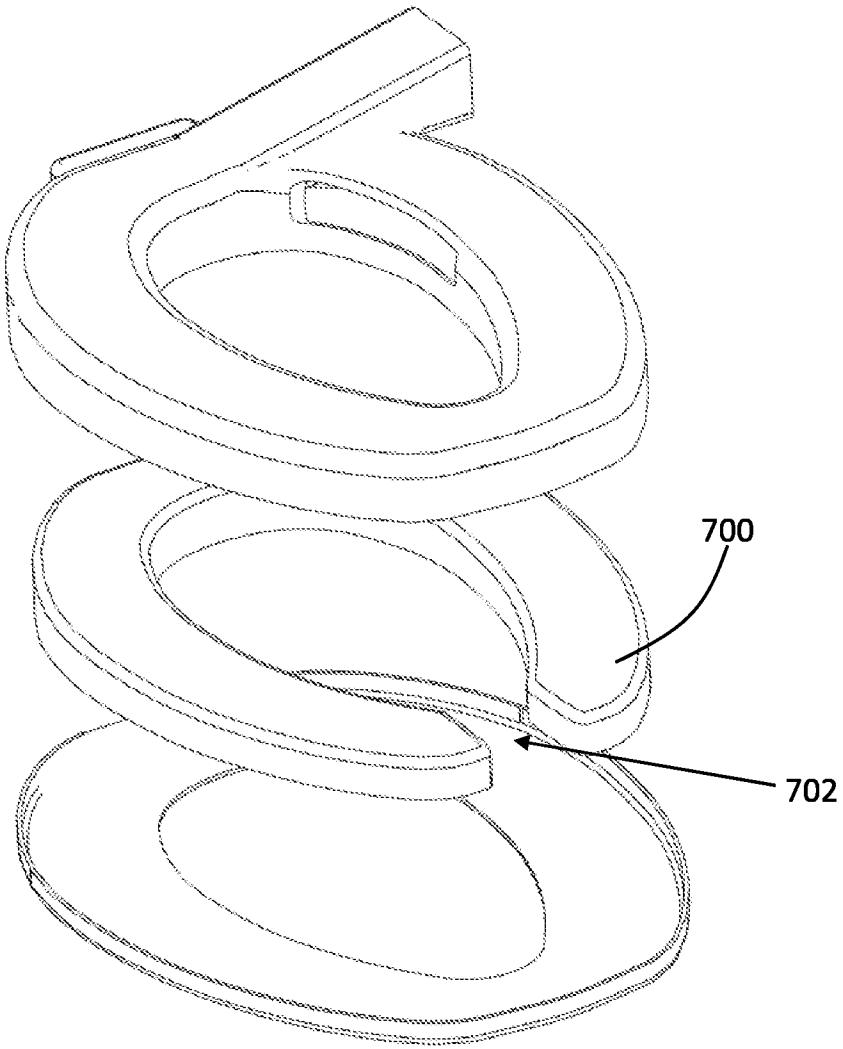
FIG. 7 is an exploded view of a toilet seat cover assembly in accordance with one embodiment of the present invention.
Figure 8:
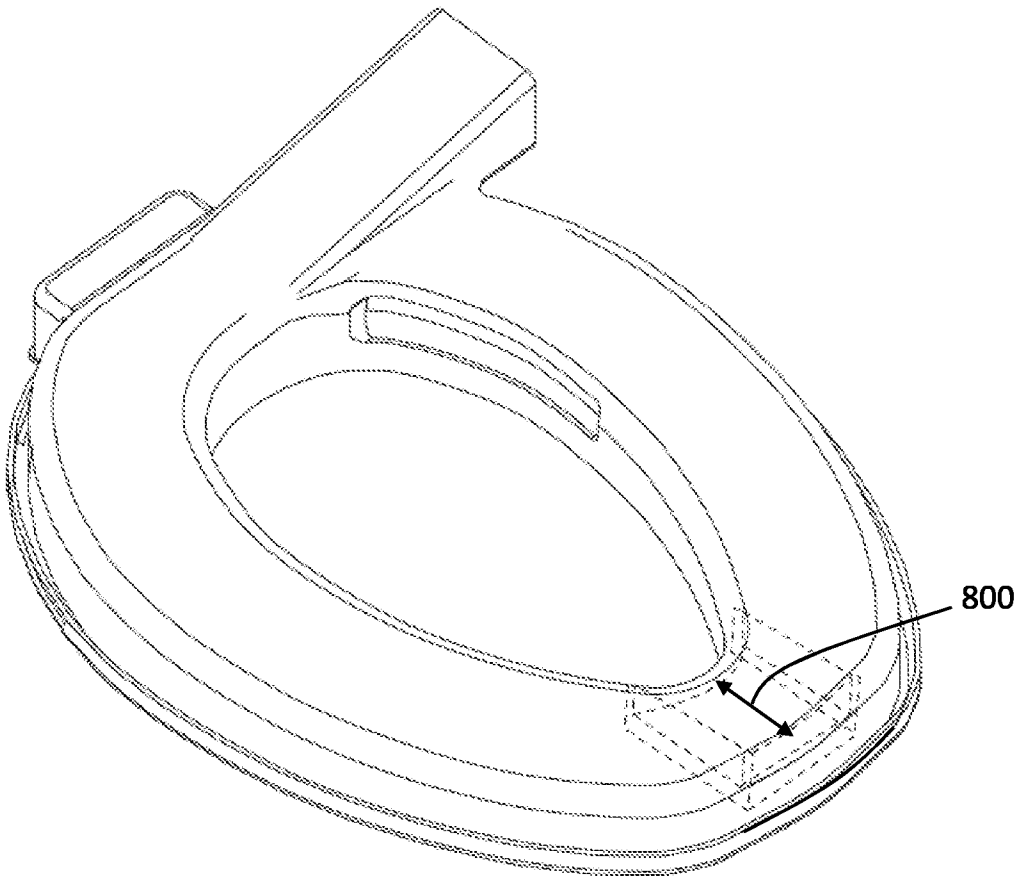
FIG. 8 is an isometric and fragmentary view of the cover assembly of FIG. 7 with the cover in a closed position in accordance with one embodiment of the present invention.

Referring now to FIGS. 1-3 and utilizing the incorporated disclosure referenced above, one embodiment of the present invention is shown. FIGS. 1-3 show several advantageous features of the present invention, but, as will be described below, the invention can be provided in several shapes, sizes, combinations of features and components, and varying numbers and functions of the components. The first example of an autocleaning toilet seat assembly 100, as shown in FIGS. 1-3, includes a top cover portion 102 and a bottom cover portion 300. The cover assembly 100 is designed to work in combination with a circular or round toilet seat 200 and/or, with brief reference to FIG. 7, a toilet seat 700 defining a discontinuity 702. Specifically, unlike known toilet seat cleaning assemblies, the claimed assembly 100 is designed to effectuate the transfer of an emitted or discharged fluid around the top surface 202 of the toilet seat 200 in an efficient manner desired by many users and/or consumers. To effectuate a leak-free fluid flow when the cover is in the closed position, the top and bottom cover portions 102, 300 may include, for example, rubber seal(s) or a tongue-and-groove configuration, spanning a portion or all of the perimeter of the portions 102, 300.

The top cover portion 102 includes an inner surface 204 and an outer surface 104 opposing the inner surface 204. With reference to the longitudinally cross-sectional view depicted in FIG. 6, the top cover portion 102 also includes an upper wall 600 flanked by two opposing sidewalls 602, 604 extending downwardly from the upper wall 600, wherein the inner surface 204 of the upper wall 600 and two opposing sidewalls 602, 604 define a fluid transport conduit 606 to permit the discharged liquid to flow or be transported around the top surface 202 of the toilet seat 200 by a discharged gaseous matter.

Said another way, top cover portion 102 may be rotatably coupled with respect to the bottom cover portion 300 to have a cover translation path. The cover translation path includes a first position with the cover 102 surrounding the toilet seat 200 and with the two opposing sidewalls 602, 604 contouring the inner and outer circumferential surfaces of the toilet seat 200, respectively. Said another way, the inner circumferential surface of the toilet seat 200 is contoured by the inner circular sidewall 602 and the outer circumferential surface of the toilet seat 200 is contoured by the outer circular sidewall 604. To effectuate the most effective and efficient transportation of the fluid around the top surface 202 of the toilet seat 200, the inner surfaces 204 of the sidewalls 602, 604 are substantially adjacent to the inner and outer circumferential surfaces of the toilet seat 200 to minimize fluid loss as it is transported around the toilet seat 200. In some embodiments, the inner surfaces 204 of the sidewalls 602, 604 are configured to be in a watertight or airtight configuration with the inner and outer circumferential surfaces of the toilet seat 200 using, for example, rubber seals disposed circumferentially around the inner surfaces of the sidewalls 602, 604.

As best seen in FIGS. 2-3 and 5-6, the top cover portion 102 defines at least one liquid aperture 500 fluidly coupled to the fluid transport conduit 606 and defines at least one gas aperture 206 fluidly coupled to the fluid transport conduit 606. As discussed in the incorporated disclosure, an electrical system is operably configured (at a time programmed and/or otherwise desired by the user, manufacturer, or consumer) to discharge a liquid matter, from a liquid source, through the liquid aperture(s) 500 and onto a portion of the top surface 202 of the toilet seat 200. The electrical system is also operably configured to discharge a gaseous matter, from a gas source, through the gas aperture(s) 206 and into the fluid transport conduit 606 at a speed sufficient to effectuate transport of the liquid around the toilet seat 200 and out through one or more fluid discharge aperture(s) 208 and into the toilet bowl for evacuation. In one embodiment, the aperture(s) 206, 208, 500 are disposed proximal, or within 0-6 inches of, the rear end of the toilet seat 200 so that the fluid flow begins and ends at the rear portion of the toilet seat 200 where it is less likely the user will sit.

Figure 5:
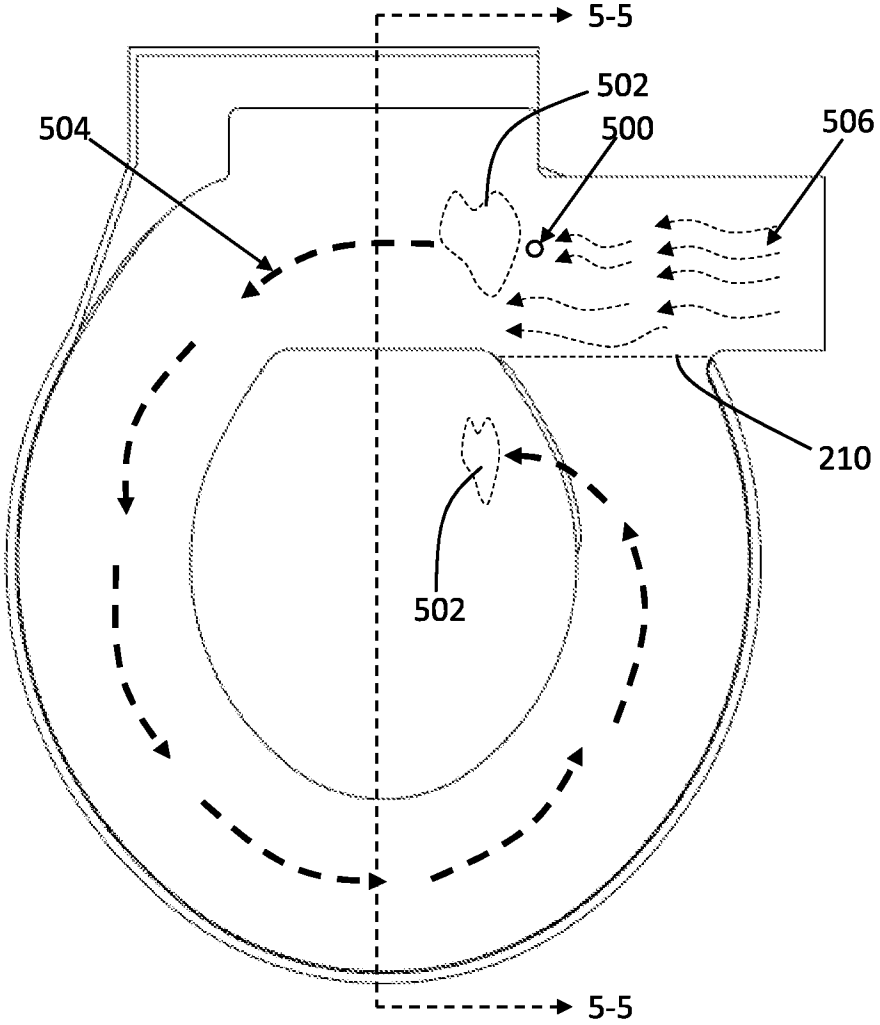
FIG. 5 is a top plan view of the cover assembly of FIG. 1.
Figure 6:
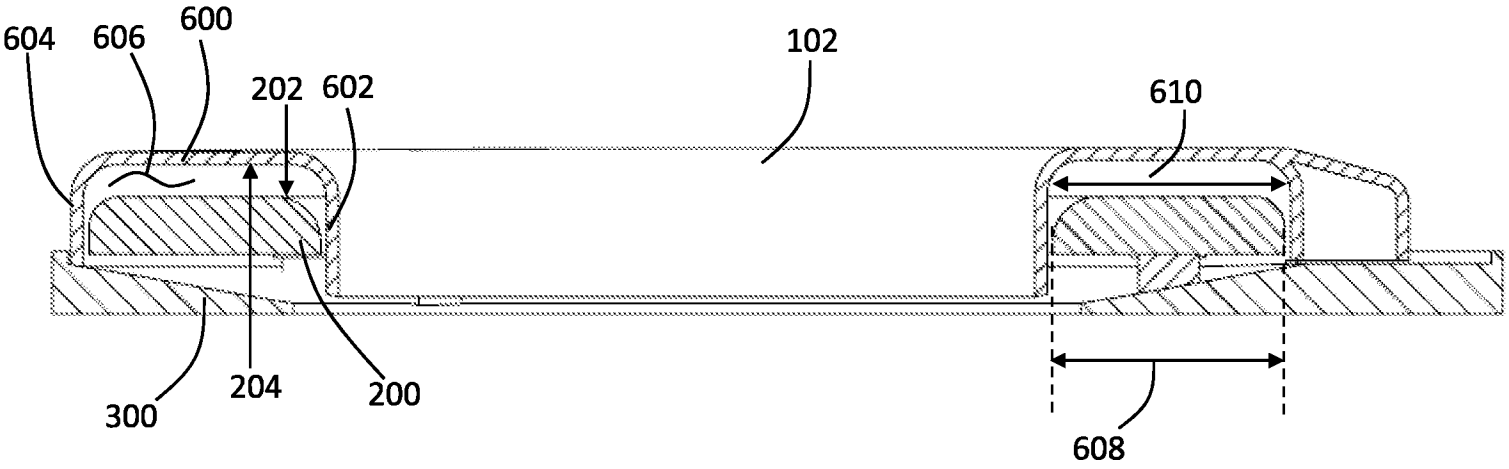
FIG. 6 is a cross-sectional view of the cover assembly of FIG. 5 along section line 5-5.

Unlike those known toilet seat cleaning assemblies, the present invention is designed to effectuate a flow of sanitizing and/or cleaning fluid around the top surface 202 of the toilet seat 200. Said another way, when the cover 102 is in the closed position the gas discharged into the channel 606 transports the discharged liquid circularly around the top surface 202 of the toilet seat 200 and through the fluid discharge aperture 208 defined on the cover 102 and into the toilet bowl for evacuation. In preferred embodiments, the top cover portion 102 is transparent or translucent for the user to visually see the fluid transportation in motion. To effectuate this fluid transportation, the fluid transport conduit 606 spans from the at least one gas aperture 206 and turns at least 180 degrees to the at least one fluid discharge aperture 208 disposed downstream of the at least one gas aperture 206. In other embodiments, the fluid transport conduit 606 spans from the at least one gas aperture 206 and turns approximately 360 degrees, i.e., +/−15 degrees, to the at least one fluid discharge aperture or port 208. Said another way, the fluid transport conduit 606 and/or the discharged fluid may span substantially the entire upper surface 202 of the toilet seat 200, i.e., minus one or more surfaces of the rear portion of the toilet seat 200. Said even further, the assembly's 100 induction of gas is of a force sufficient to transport the liquid around the seat 200 at least approximately 80% of operationally configured upper surface (i.e., the part of the toilet seat where the user conventionally sits on). As seen in FIGS. 2 and 5-6, the top surface 202 of the toilet seat 200 completely surrounds the center aperture 212 and the fluid transport conduit 606 may substantially span around the top surface 202 of the toilet seat 200.

The flow of the discharged liquid 502 and gas 506 spanning continuously around the toilet seat 200 and can be seen depicted in FIG. 5, through arrows 504. As discussed in the incorporated disclosure, the liquid discharge may be a liquid stream or atomized liquid spray of water, disinfectant, a combination of water and/or disinfectant, a liquid vapor, or other liquid. Additionally, the induced flow of gas as it enters the conduit 606 can also be seen depicted through arrows 506. With reference now to FIGS. 2, 5-6, and 9-10, to facilitate in directing the flow of the liquid and gas matter 504 continuously around the continuous toilet seat 200, the assembly 100 may beneficially include an air deflector 210, 900, also referred to herein as a wall divider, coupled to top cover portion 102. The wall divider 210, 900 extends downwardly from the inner surface 204 of the upper wall 600 of the cover 102 as seen in the figures. Additionally, the wall divider 210, 900 beneficially interposes the gas aperture(s) 206 and the fluid discharge aperture(s) 208. The wall divider 210, 900 includes a lower surface disposed adjacent, i.e., substantially adjacent, to the top surface 202 of the toilet seat 200 when the cover 102 is in the first, closed, position. The wall divider 210, 900 may also be beneficially disposed proximal to the back end of the toilet seat 200 when the cover is in the first, closed, position to, again, minimize the user's exposure of any remaining fluid or other contaminants or debris. The air deflector controls or deflects the air to direct it around the fluid transport conduit 606, thereby facilitating in transporting the liquid around the top surface 202 of the toilet seat 200.

In one embodiment, the lower surface (shown best in FIG. 2) of the wall divider 210, 900 may couple to the upper surface 202 of the toilet seat 200 in a substantially watertight and/or airtight configuration. As such, the lower surface 902 of the wall divider 210, 900 may include a rubber seal that is operably configured to effectuation such a configuration. In other embodiments, the lower surface of the wall divider 210, 900 may be disposed proximal to the upper surface 202 of the toilet seat 200. Like the upper wall 600 and sidewalls 602, 604, the wall divider 210, 900 may be free of any openings to minimize loss of air pressure forcefully transporting the liquid around the top surface of the toilet seat 200. The wall divider 210, 900 may span the entire width 608 of the toilet seat 200 and may also be shaped to contour the shape of the upper surface 202 of the toilet seat 200. The width 610 of the conduit 606 may also be substantially equal, i.e., +/−15% deviation, to the width 608 of the toilet seat 200. In one embodiment, the wall divider 210, 900 is of a thickness that is approximately 0.25". Other dimensions, however, may be used depending on design or manufacturing constraints and the shape of the toilet seat 200.

Figure 16:
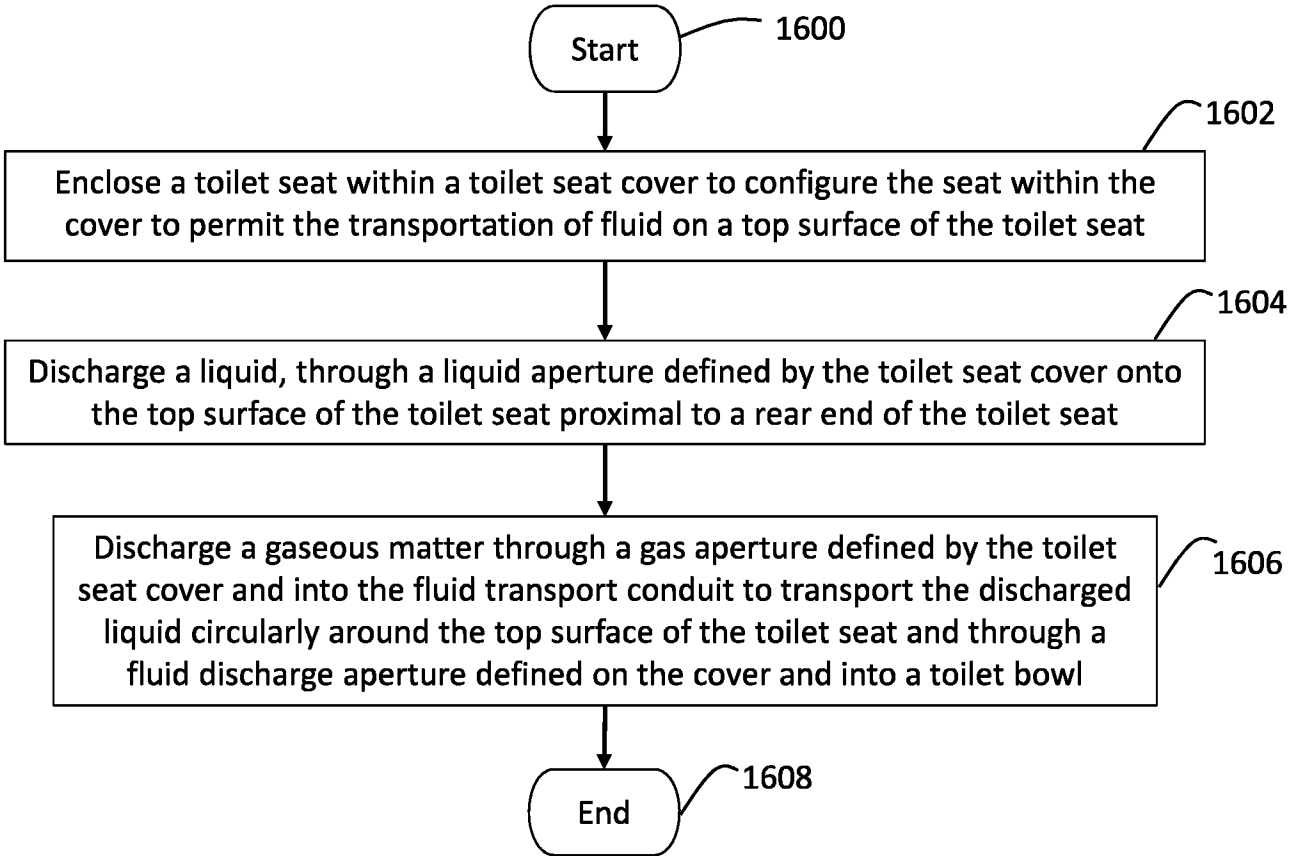
FIG. 16 is a process flow diagram depicting exemplary steps of automatically cleaning a toilet seat.

Moreover, a process flow diagram showing exemplary steps in automatically cleaning a toilet seat can be seen depicted in FIG. 16, wherein the process begins at step 1600 and terminates at step 1608. The figures depicted are described in conjunction with the process flow chart of FIG. 16 and, although FIG. 16 shows a specific order of executing the process steps, the order of executing the steps may be changed relative to the order shown in certain embodiments. Also, two or more blocks shown in succession may be executed concurrently or with partial concurrence in some embodiments, unless otherwise indicated herein. Certain steps may also be omitted in FIG. 16 for the sake of brevity. In some embodiments, some or all of the process steps included in FIG. 16 can be combined into a single process.

Figure 12:
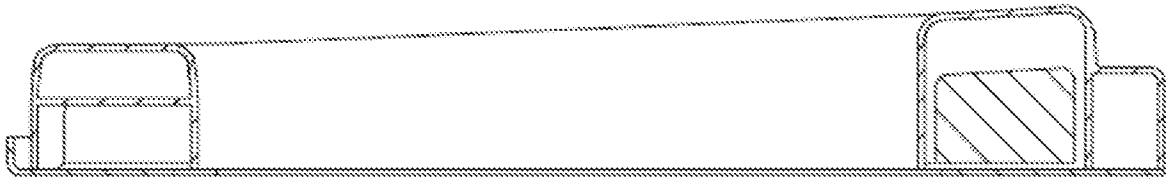
FIG. 12 is a cross-sectional view of the cover assembly of FIG. 11 along section line 11-11.
Figure 13:
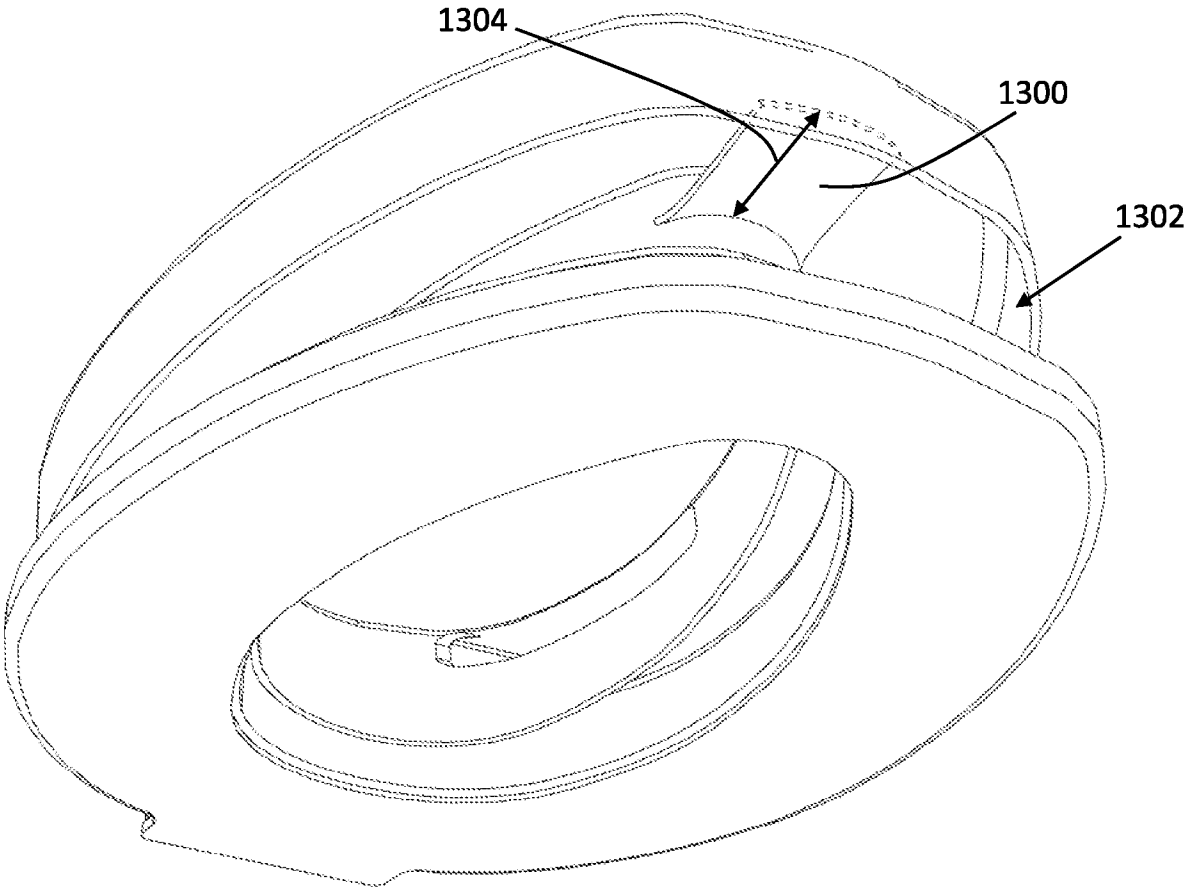
FIG. 13 is a perspective bottom view of a toilet seat cover assembly in accordance with another embodiment of the present invention.
Figure 14:
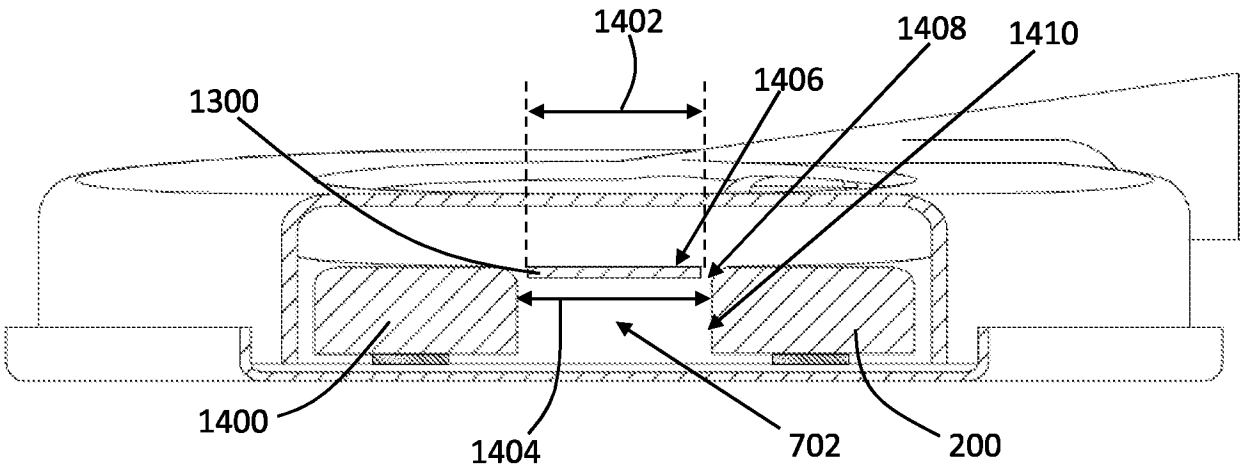
FIG. 14 is a cross-sectional view of the cover assembly of FIG. 13 along a section of a front end of the cover assembly.
Figure 15:
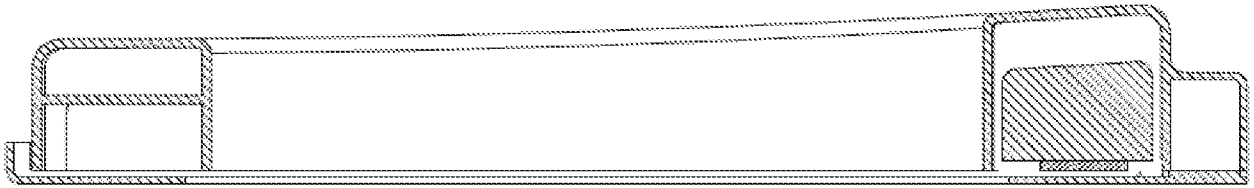
FIG. 15 is a cross-sectional view of the cover assembly of FIG. 13 along a longitudinal mid-section of the cover assembly.

The process may proceed from step 1600 to the step 1602 of enclosing a toilet seat 200 of a toilet within a toilet seat cover 100 to define a closed position with an inner and outer circumferential surface of the toilet seat adjacent, i.e., substantially adjacent, to and contoured by two opposing sidewalls 602, 604, respectively, of the toilet seat cover 100 to define the fluid transport conduit 606 disposed directly above the top surface 202 of the toilet seat 200 (as shown best in FIGS. 6, 12, and 14). The process may continue to step 1604 of discharging a liquid, through the one or more liquid aperture(s) 500 defined by the toilet seat cover 100 and, when in the closed position, onto the top surface 202 of the toilet seat 200 proximal to a rear end of the toilet seat 200. Continuing further, the process includes discharging a gaseous matter, when in the closed position, through one or more gas aperture(s) 206 defined by the toilet seat cover 100 and into the fluid transport conduit 606 to transport the discharged liquid circularly around the top surface 202 of the toilet seat 200 and through a fluid discharge aperture 208 defined on the cover 100 and into the toilet bowl. As discussed in the incorporated disclosure, the gas discharge may be effectuated with, for example, an air mover or fan (also commonly referred to as a "blower"). The bottom cover portion 300, including its canted or sloped surfaces, facilitate in draining any potential fluid run-off into the toilet bowl for evacuation by the user (in addition to facilitating the cleaning of the bottom surface of the toilet seat 200). The cover may also employ the use of UV emitters disposed circumferentially around the cover and electrically coupled to a power source, wherein they are operable to emit UV when the cover is in the closed position.

Figure 9:
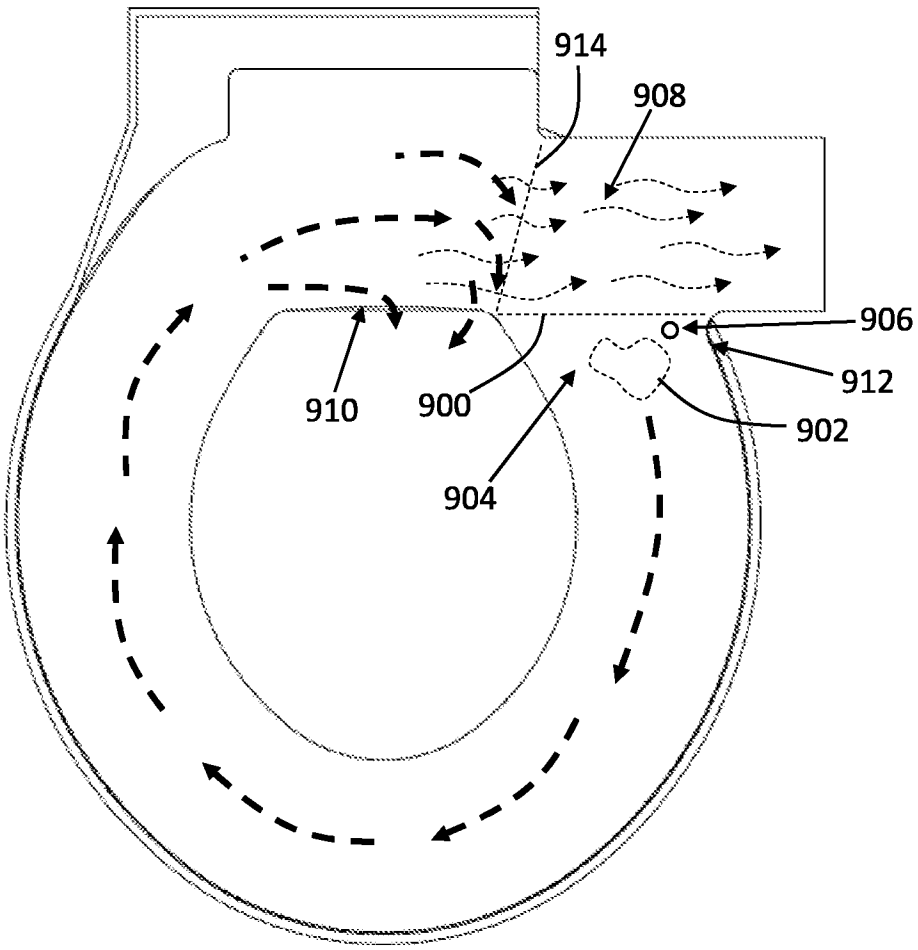
FIG. 9 is a top plan view of a cover assembly in accordance with another embodiment of the present invention.
Figure 10:
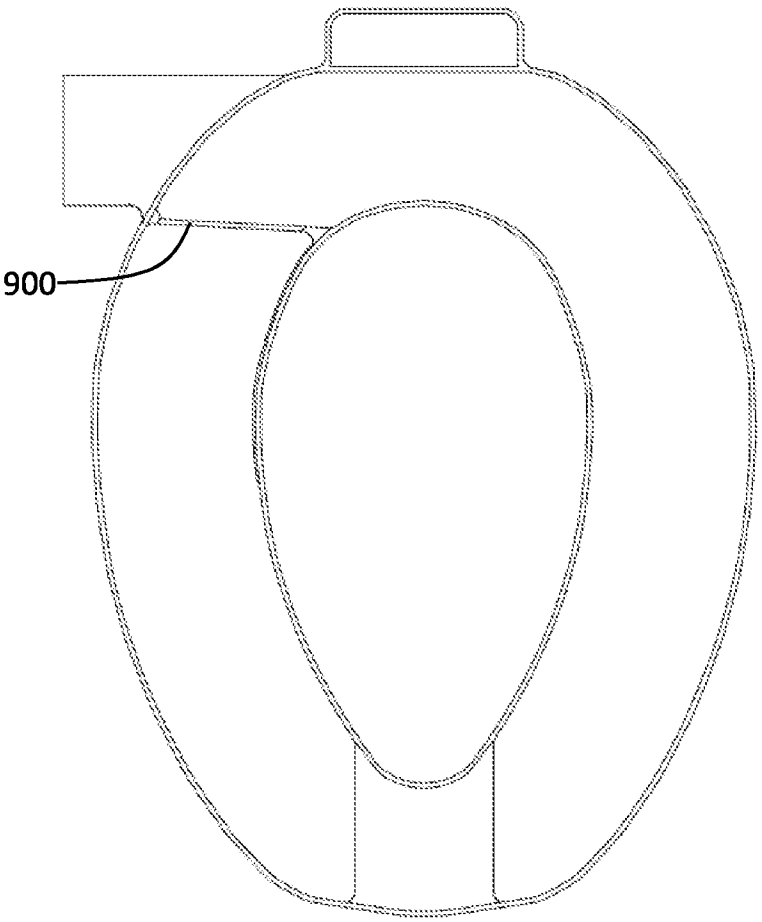
FIG. 10 is a plan view of the bottom of the cover in the cover assembly of FIG. 7 in accordance with one embodiment of the present invention.
Figure 11:
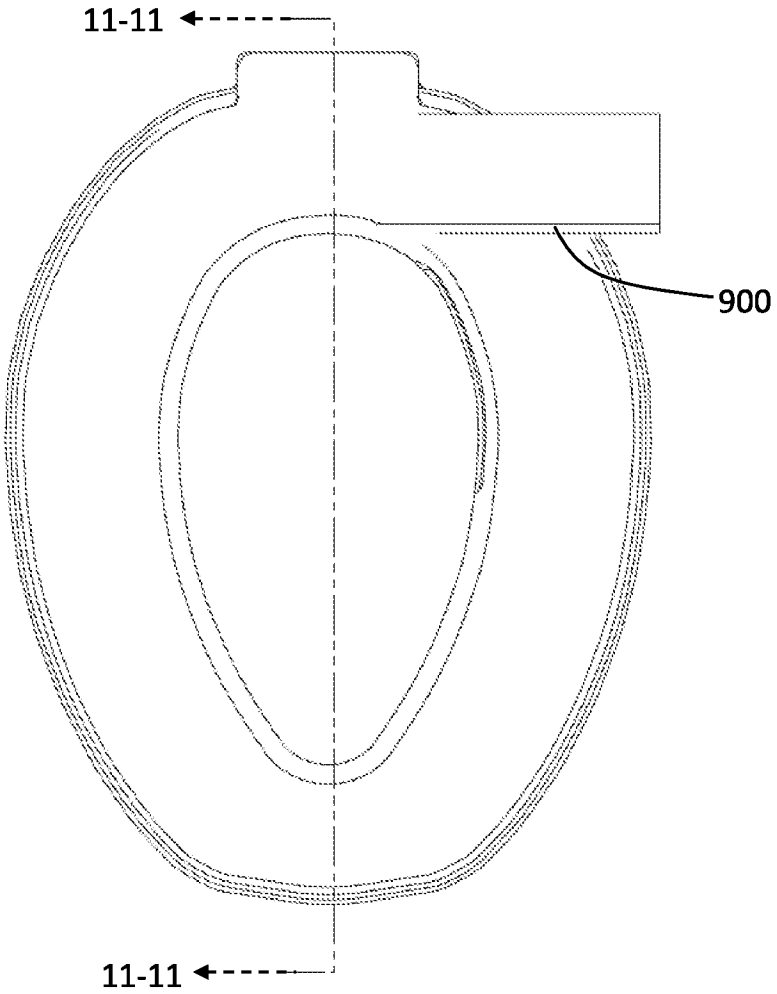
FIG. 11 is a top plan view of the cover assembly of FIG. 7.

With reference to FIGS. 6 and 9, in one embodiment of the present invention, the transportation of the discharged liquid circularly around the top surface 202 of the toilet seat 200 may be effectuated by inducing flow of negative pressure or vacuum within the channel 606. A representation of said process can be seen in FIG. 9. Specifically, after liquid 902 is discharged, e.g., via a nozzle, proximal to a rear portion 904 of the toilet seat 200 through, for example, a liquid aperture 906 defined on the cover that is fluidly coupled, through a fluid line, to a fluid source, a vacuum (represented by arrows 908) is induced by the air mover. The configuration of the sidewalls 602, 604 and channel 606 with respect to the toilet seat 200 enables the discharged liquid 902 to travel from the location on the seat which the liquid 902 is discharged, around the toilet seat 200, and to the discharge aperture 910 defined on the cover and disposed downstream in the channel 606 proximal to the back end 906 of the toilet seat 200, wherein the discharged liquid 902 flows into the toilet bowl. To prevent a complete vacuum within the channel 606, the cover may define an aperture 912 disposed adjacent to the wall 900 and proximal to the area in which the liquid 902 is emitted. Moreover, the cover may employ the use of a secondary deflection wall 914, or air deflector that is disposed downstream of the exit aperture 910 in the channel 606. The secondary deflection wall 914 is used to deflect and/or control incoming liquid transported by the induced vacuum through the discharge aperture 910 and into the toilet bowl for evacuation by the user. To facilitate in deflecting the incoming liquid, while permitting airflow by the air mover, the secondary deflection wall 914 may only partially extend upwardly along the inner surfaces of the sidewalls 602, 604 substantially from the top surface 202 of the toilet seat 200. The bottom surface of the secondary deflection wall 914 may also include a rubber seal to prevent incoming liquid from passing out of the conduit 606 and into the air mover assembly. Said another way, the secondary deflection wall 914 is disposed in a lower portion of the conduit 606 adjacent to the top surface 202 of the toilet seat 200, while the upper portion of the conduit is open permitting for gas flow induced by the air mover.

With reference now to FIGS. 8-9, 11-15, the cover assembly 1100 may include a tongue member 1300 projecting from the inner surface 1302 of the one or more two opposing sidewalls 602, 604 (shown best in FIG. 6). The tongue member 1300 is a relatively thin piece of material, e.g., approximately 0.25", that may be of the same material as the cover 102, e.g., PVC. The tongue member 1300 is operably configured for use with toilet seats 1400 having one or more spatial discontinuities 702 disposed thereon, particularly at the front end of the toilet seat 1400. The tongue member 1300 may beneficially have a width 1402 and length 1304 defining a tongue area that is substantially equal to the discontinuity area, i.e., the length 800×width 1404. Advantageously, the top surface 1406 of the tongue member 1300, when the cover 102 is in the closed position, is flanked by the top surface 202 of the toilet seat 200 and are aligned with one another (as shown best in FIG. 14). The tongue member 1300 may also have a length 1304 spanning substantially a distance separating the inner surfaces 1302 of, i.e., equal to or within 1-2" within, the inner and outer circular sidewalls 602, 604. While FIG. 14 depicts a discontinuity between the tongue member 1300 and side top surfaces 202, the drawings are not to scale and the top surface 1406 of the tongue member 1300 may continuously connect the adjacent side top surfaces 202 to effectuate a continuous flow of liquid around the toilet seat 200. In other embodiments, the tongue member 1300 may not continuously connect the adjacent side top surfaces 202, to permit slight liquid run-off through the apertures 1408, thereby cleaning the sides 1410 of the toilet seat 200 and run-off into the toilet bowl.

Figure 17:
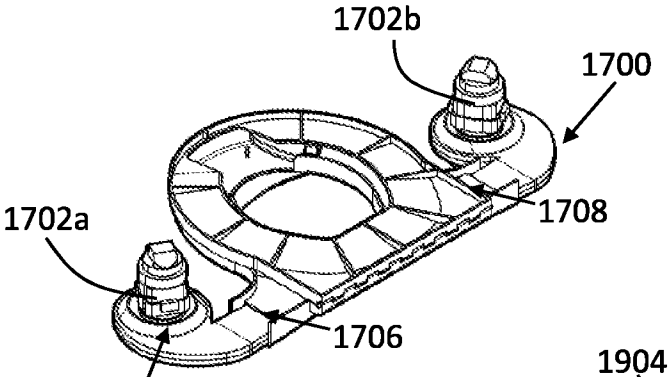
FIG. 17 is an isometric bottom view of a toilet seat cover assembly in accordance with another embodiment of the present invention.
Figure 19:
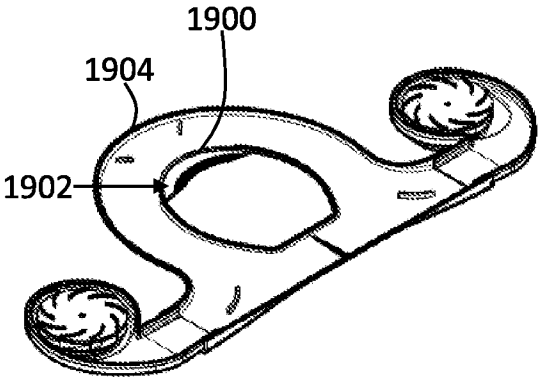
FIG. 19 is an isometric top view of a bottom portion of the toilet seat cover assembly in FIG. 17.
Figure 18:
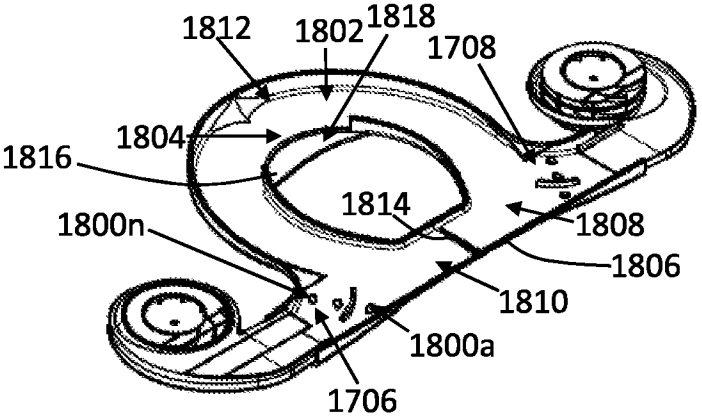
FIG. 18 is an isometric bottom view of an upper portion of the toilet seat cover assembly in FIG. 17.
Figure 21:
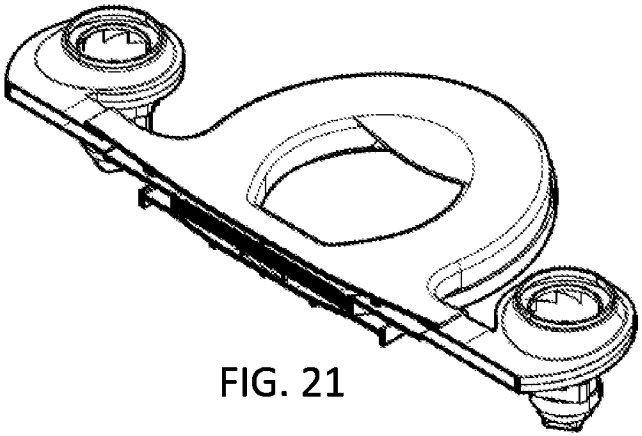
FIG. 21 is a cross-sectional view along section line 20-20 of the toilet seat cover assembly in FIG. 20.
Figure 23:
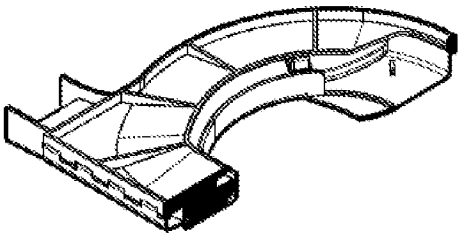
FIG. 23 is a cross-sectional view along section line 21-21 of the toilet seat cover assembly in FIG. 20 in accordance with another embodiment of the present invention.
Figure 20:
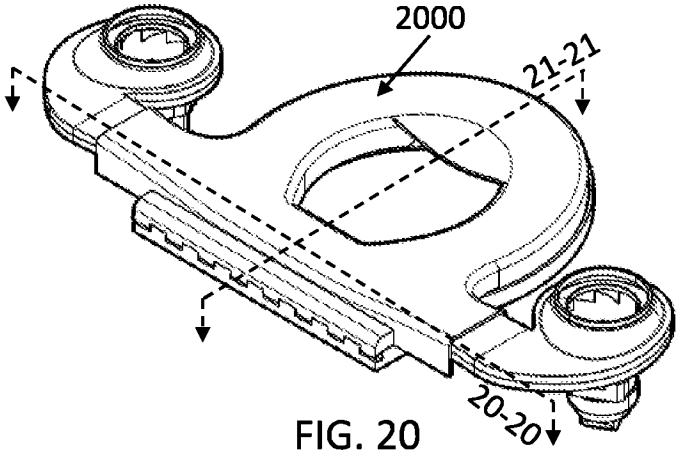
FIG. 20 is an isometric top view of the toilet seat cover assembly in FIG. 17.
Figure 22:
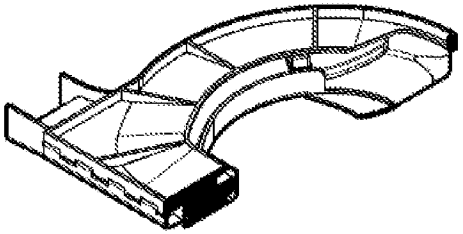
FIG. 22 is a cross-sectional view along section line 21-21 of the toilet seat cover assembly in FIG. 20.

With reference now to FIGS. 17-19, another embodiment of an auto cleaning toilet seat assembly 1700 can be seen. Similar to the above-described toilet seat cleaning assemblies, the auto cleaning toilet seat assembly 1700 includes one or more air mover(s) 1702*a-b*, e.g., an air turbine, and one or more liquid apertures 1800*a-n* fluidly coupled to a liquid source, e.g., a disinfectant solution for cleaning the top surface of the toilet seat. Similarly, and also with brief reference to FIG. 26, an electrical system 1704 is operably configured emit a liquid matter 2600, from a liquid source, to discharge, through the at least one liquid aperture, e.g., aperture 1800*a*, onto a portion of the top surface of the toilet seat proximal to at least one gas aperture 1706. In one embodiment, "proximal" may be within approximately 6 inches, while in other embodiments, depending on the sufficiency of the volumetric flow rate of the gas, may be within approximately 12 inches.

The induced flow of gaseous matter, from a gas source, discharges through the at least one gas aperture 1706, at a speed sufficient to transport the liquid matter 2600 through the fluid transport conduit 1802, on the top surface 2700 of toilet seat 2702, and through the discharge aperture 1804. The transportation of the induced gas and liquid is represented by arrows 2602 in FIG. 26. As described previously, however, the air mover(s) 1702*a-b*, liquid apertures 1800*a-n*, and electrical components associated therewith, may have various applications and configurations.

As shown best in FIGS. 26-29 and described above, the assembly is employed in connection with a toilet having a toilet bowl and a toilet seat 2702 coupled to the toilet bowl. The toilet seat 2702 defines a center aperture 2704 and includes a front end 2706, a back end 2708, a top surface 2700, an inner circumferential surface 2900, and an outer circumferential surface 2902. Referring back to FIGS. 17-20, the cover 1806 has an inner surface 1808 and an outer surface 2000 opposing the inner surface 1808. Also with reference to FIG. 29, the cover also includes a back end 1810, a front end 1812, an upper wall 2904 flanked by an outer sidewall 2906 and an inner sidewall 2908. Both the outer and inner sidewalls 2906, 2908 oppose one another, extending downwardly from the upper wall 2904, and have inner surfaces defining the fluid transport conduit 1802. When the cover 1806 is in the closed or first position (shown best in FIG. 26) along a cover translation path (an exemplary path is represented by arrows 2710 in FIG. 27), the top surface 2700 of the toilet seat 2702 also defines the fluid transport conduit 1802, i.e., where gas/liquid can move. The translation path 2710 may be circular, effectuated through a hingedly coupled relationship between an upper portion 2712 of the cover 1806 and a bottom portion 2800 of the cover 1806.

When in the first position, the fluid transport conduit 1802 spans from the back end 2708 of the toilet seat 2702 to the front end 2706 of the toilet seat 2702 and terminates at the discharge aperture 1804. The first position also includes the cover 1806 surrounding the toilet seat 2702. The second position (shown best in FIG. 27) along the cover translation path 2710 includes the cover 1806 removed from the toilet seat 2702.

As best seen in FIGS. 18, 24-25, and 29, the cover 1806 beneficially includes an air deflector 2400 disposed on the upper wall 2904, the inner surface 2402 of the outer sidewall 2906, and at the front end 1812 of the cover 1806. To direct air and liquid to the discharge aperture 1804, the air deflector 2400 includes two opposing surfaces 2404, 2406 converging together away from the inner surface 2402 of the outer sidewall 2906. As such, when gas is introduced into the fluid transport conduit 1802, the configuration and orientation of the air deflector 2400 facilitate in effectively and efficiently evacuating substantially all the liquid matter disposed on the top surface 2700 of the toilet seat 2702. To further facilitate in gas/liquid evacuation, the cover 1806 may also include one or more directional air fins 2408, 2410 coupled to the inner surface 2412 of the upper wall 2904. More specifically, testing has shown that the orientation and configuration of the directional air fins 2408, 2410 generate a turbulent flow directing the fluid toward either the air deflector 2400 or the discharge outlet 1804 for evacuation from the fluid transport conduit 1802.

With reference to FIGS. 24-29, the inner surface 2402 of outer sidewall 2906 continuously contours the outer circumference surface 2902 of the toilet seat 2702 from the back end 2708 of the toilet seat 2702 to the front end 2706 of the toilet seat 2702 to ensure the liquid matter 2600 is transported around the top surface 2700 of the toilet seat 2702. Similarly, the inner surface of the inner sidewall 2908 continuously contours the inner circumference surface of the toilet seat 2702 from the back end 2708 of the toilet seat 2702 to the front end 2706 of the toilet seat 2702 to define the discharge aperture 1804 disposed at the front end 2706 of the toilet seat 2702. In one embodiment, the discharge aperture 1804 is a single aperture designed to permit evacuation of the fluids into the toilet bow of the toilet.

Advantageously, the two opposing surfaces 2404, 2406 of the air deflector 2400 converge in an orientation toward the discharge aperture 1804. In one embodiment, the surface 2404 is disposed on a first side 2414 of the cover 1806 and the surface 2406 is disposed on a second side of the cover 1806. The opposing surfaces 2404, 2406 may also be symmetrically disposed adjacent to an axis 2500 defined by a centroid or center of gravity of the cover 1806. To that end, the cover 1806 may include two gas apertures 1706, 1708 defined thereon and disposed at the back end 1810 of the cover 1806. The gas apertures 1706, 1708 may oppose one another and each may respectively orient toward different side portions of the fluid transport conduit 1802. Said differently, the gas apertures 1706, 1708 may also be symmetrically disposed to more effectively provide gas to each portion of the conduit 1802, thereby effectuating a more efficient transportation of the emitted liquid over the top surface 2700 of the toilet seat 2702 and out through the discharge aperture 1804.

Figure 24:
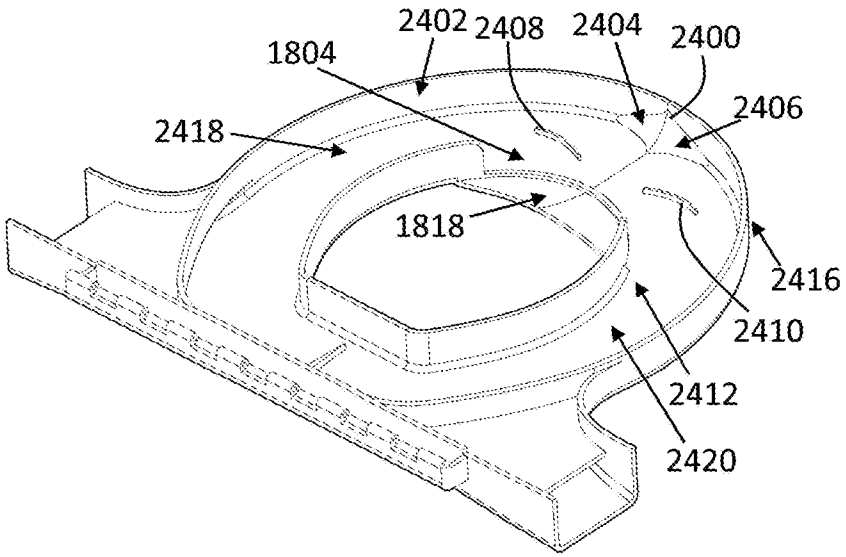
FIG. 24 is an isometric bottom view of an upper portion of the toilet seat cover assembly in accordance with another embodiment of the present invention.
Figure 28:
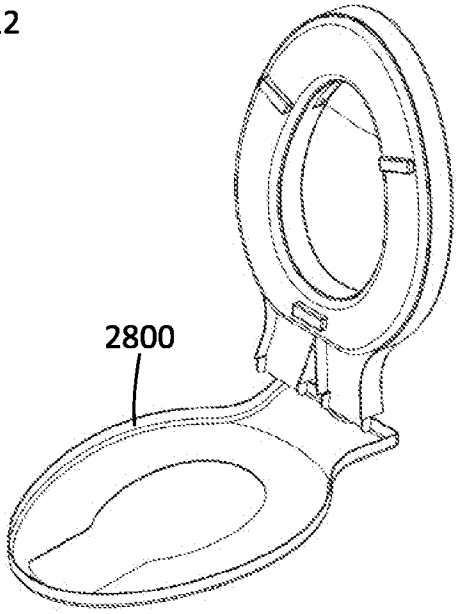
FIG. 28 is an isometric top view of the upper portion of the toilet seat cover assembly and the toilet seat of FIG. 26 in the first position along the cover translation path.
Figure 27:
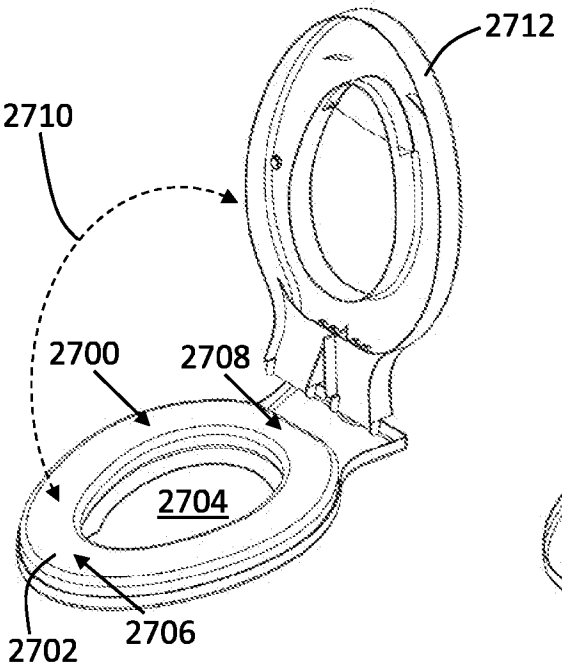
FIG. 27 is an isometric top view of the upper portion of the toilet seat cover assembly in FIG. 26 in a first position along the cover translation path.

In some embodiments, the cover 1806 may include a rear center air deflector 1814 to deflect incoming gas through the conduit 1802. The rear center air deflector 1814 is particularly beneficial with configurations of the air movers 1702*a-n* and gas apertures 1706, 1708 flanking the conduits 2418, 2420 from the side. However, as depicted in other figures, e.g., FIG. 25, the air movers 1702*a-n* and gas apertures 1706, 1708 may be disposed in the back end 2504 of the cover 2502. That said, the rear center air deflector 1814 may extend downwardly from the inner surface 1808 of the upper wall 2904 and may also be disposed centrally between the gas apertures 1706, 1708 at the back end 1810 of the cover 1806 and/or disposed on the axis 2500. The distal end of the rear center air deflector 1814 may be sized to terminate at or within approximately 1-2 inches of the top surface 2700 of the toilet seat 2702. In other embodiments, the rear center air deflector 1814 extends partially into the conduit 1802. As best seen in FIG. 24, the rear center air deflector 1814 partitions the fluid transport conduit 1802 into a first side fluid transport conduit 2418 and a second side fluid transport conduit 2420. The first and second side fluid transport conduits 2418, 2420 are respectively disposed over one of the side top surfaces 2700 of the toilet seat 2702 when the cover 1806 is in the first position along the cover translation path.

Figure 25:
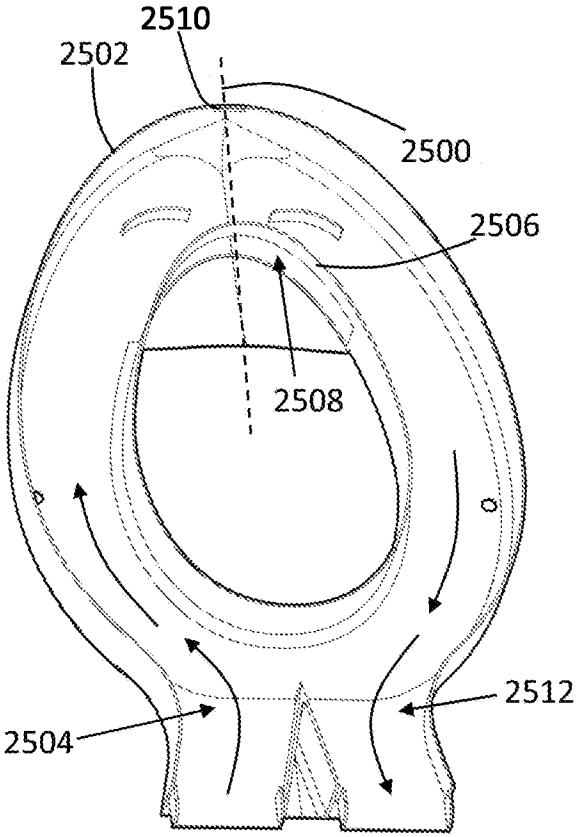
FIG. 25 is an isometric bottom view of an upper portion of the toilet seat cover assembly in accordance with yet another embodiment of the present invention.
Figure 29:
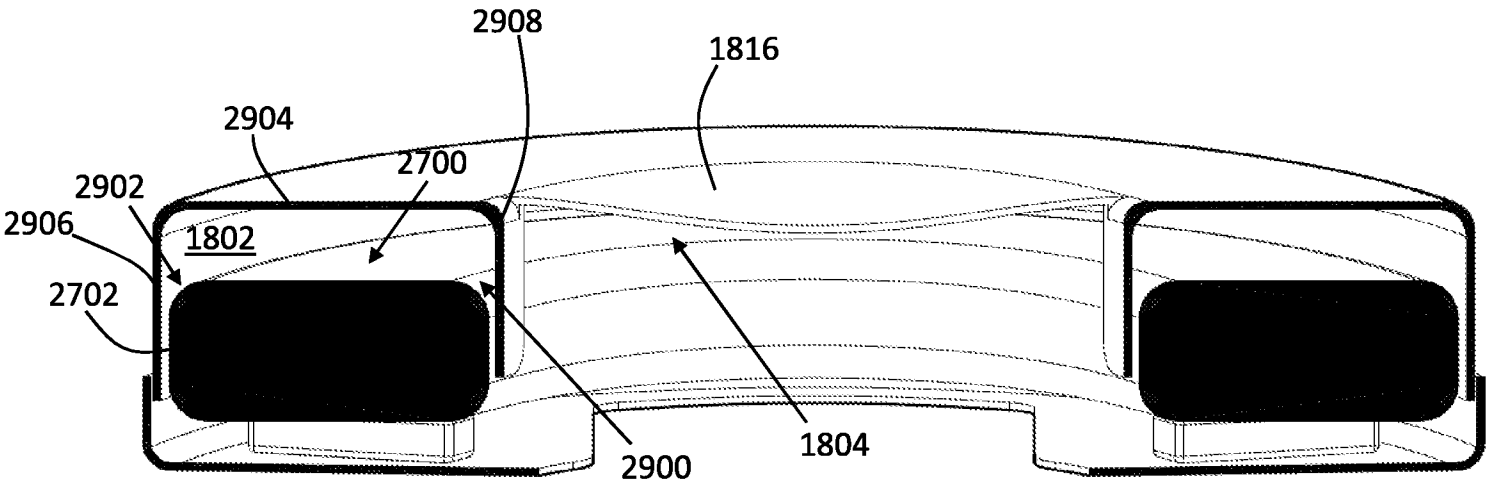
FIG. 29 is a cross-sectional view along section line 26-26 of the toilet seat cover assembly in FIG. 26.
Figure 30:
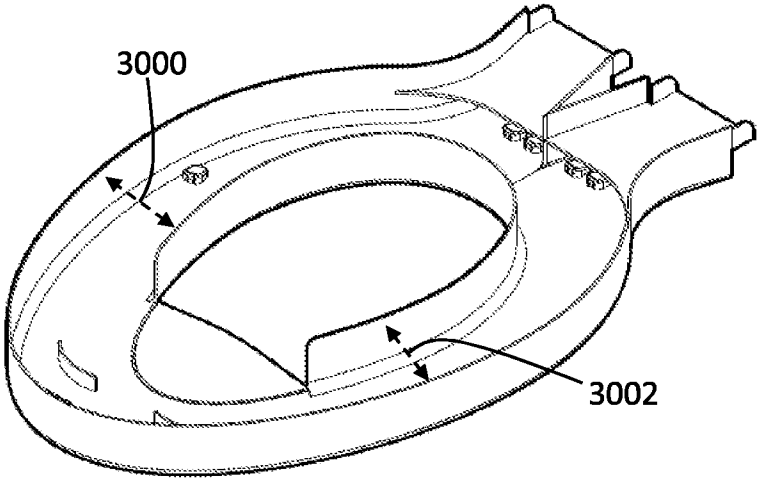
FIG. 30 is an isometric bottom view of an upper portion of a toilet seat cover assembly in accordance with another embodiment of the present invention.

In one embodiment, the first and second side fluid transport conduits 2418, 2420 may respectively taper in width, e.g., widths 3000, 3002 shown in FIG. 30, at or proximal to the front end 1812 of the cover 1806. The reduction in width also facilitates in the evacuation of the fluids by increasing the velocity of the air transporting through the conduits 2418, 2420. As shown in FIG. 25, to effectively direct transported fluid, a portion 2506 of the inner surface of the inner sidewall continuously contours the inner circumference surface of the toilet seat from the back end of the toilet seat to the front end, wherein the single discharge aperture 2508 is interposed by the portion 2506 of the inner sidewall and the upper wall of the cover 2502. Should the portion 2506 of the inner sidewall protrude above the upper surface of the toilet seat, the discharge aperture 2508 may only permit evacuation of the gas, while inhibiting emitted liquid from being evacuated. In other embodiments, there will not be a watertight seal between the wall of the material 2506, or any part of the wall 2908, and the inner circumference 2900 of the toilet seat 2702. In said embodiment, some of the transported liquid is advantageously permitted to seep through the gap in said walls/surfaces (as best seen in FIG. 29) to clean the sides of the toilet seat 2702 and ultimately be evacuated into the toilet bowl. Should the portion of the inner sidewall not protrude above the upper surface of the toilet seat, i.e., the upper surface of the portion 2506 defining the aperture 2508 is flush or below the upper surface of the toilet seat, the discharge aperture 2508 will permit evacuation of both liquid and gas.

With reference to FIGS. 18-19 and 27-29, the upper portion 2712 of the cover 1806 includes an upper hood 1816 coupled to the upper wall 2904 of the cover 1806. The upper hood has an inner surface 1818 extending from the single discharge aperture 1804 and oriented toward the toilet bowl when the cover 1806 is in the first position along the cover translation path. The bottom portion 2800 of the cover 1806 may include a bottom hood 1900. The upper hood 1816 also ensures any fluid transported around the conduit 1802 is directed into the toilet bowl. The bottom hood 1900 ensures any errand or leaked fluid from the conduit 1802 on the bottom portion 2800 also is directed into the toilet bowl. Like the upper hood 1816, the bottom hood 1900 also includes an inner surface 1902 oriented toward the toilet bowl to effectively evacuate circulating fluid.

To that end, with reference to FIGS. 17-19 and 25, the assembly 1700 may include a pair of magnets 1904, 2510 that are operably configured to be attracted to one another when the cover is in the closed position along the cover translation path. In one embodiment, one or more of the magnets 1904, 2510 may be electromagnets. As those of skill in the art will appreciate, an electromagnet is a type of magnet in which the magnetic field is produced by an electric current. The magnetic field disappears when the current is turned off. An electromagnet usually includes insulated wire wound into a coil. A current through the wire creates a magnetic field which is concentrated in the hole in the center of the coil. The wire turns are often wound around a magnetic core made from a ferromagnetic or ferrimagnetic material such as iron. The magnetic core concentrates the magnetic flux and makes a more powerful magnet. As such, one or more of the magnets may be electrically coupled to a power source, e.g., a 12 VDC power source. Power may be provided to the electromagnet(s) when the cover 1806 closes, thereby activating a switch closing a circuit to the power source and the electromagnet. In alternative embodiments, power may be provided to the electromagnet through use of one or more sensors, e.g., a gyroscope or light sensors, that are operably configured to detect when the cover 1806 is closed.

Figure 26:
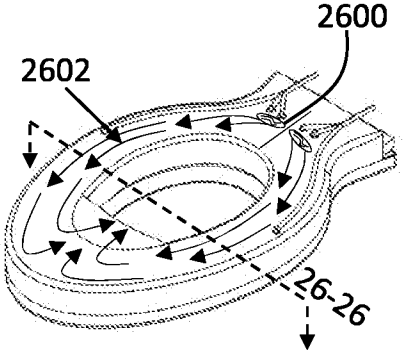
FIG. 26 is an isometric top view of an upper portion of a toilet seat cover assembly in a second position along a cover translation path in accordance with another embodiment of the present invention.

With reference to FIGS. 24-26 and as described above, a representative flow is depicted with arrows 2602. In other embodiments, however, represented in FIG. 25, another potential directional flow can be seen. In said embodiment, the gas may be induced through one conduit by an air mover, while a vacuum may be induced through another conduit 2420. As such, liquid may be emitted onto the top surface of the toilet seat 2702 proximal to the rear end 2708, wherein the induced gas transports the liquid around the toilet seat. In some embodiments, the emitted liquid The vacuum induced in the second conduit 2420 facilitates in removing any emitted liquid not removed through the discharge aperture 1804, through the gas aperture 2512. While the velocity of the air and pressures generated within the conduits 2418, 2420 will generally prevent the induced gas and vacuum from disrupting the flow, a rear air deflecting wall may be interposed therein for also preventing the disrupted flow. One application of the assembly 1700 may be employed on an airplane, whereby said vacuum is induced on the convention suction or vacuum generated on an airplane toilet seat assembly. Specifically, once the cover 1806 is in the closed position, the assembly 1700, which may not utilize a vacuum to assist in evacuating emitted fluid, may utilize a vacuum-assist generated from the airplane toilet seat assembly to assist in said evacuation. Additionally, the assembly 1700 may be beneficially utilized with a circular toilet seat or a circular toilet seat, unlike many of those known toilet seat cleaning assemblies.

Figure 31:
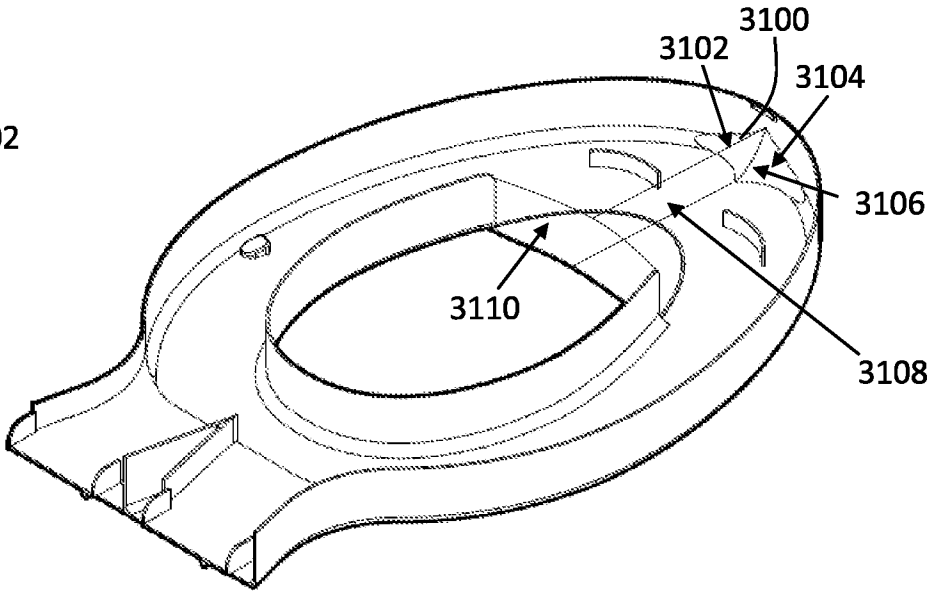
FIG. 31 is another isometric bottom view of the upper portion of a toilet seat cover assembly in accordance with another embodiment of the present invention.

With reference to FIGS. 30-31, the two opposing surfaces 3102, 3104 of the air deflector may converge together to form an air deflector joint 3106 substantially aligned with a discharge aperture axis 3108 defined by a centroid of the discharge aperture 3110. Said another way, the air deflector 3100 beneficially directs fluids toward the substantial center of the aperture to maximize effective and efficient evacuation of the fluids.

Figure 32:
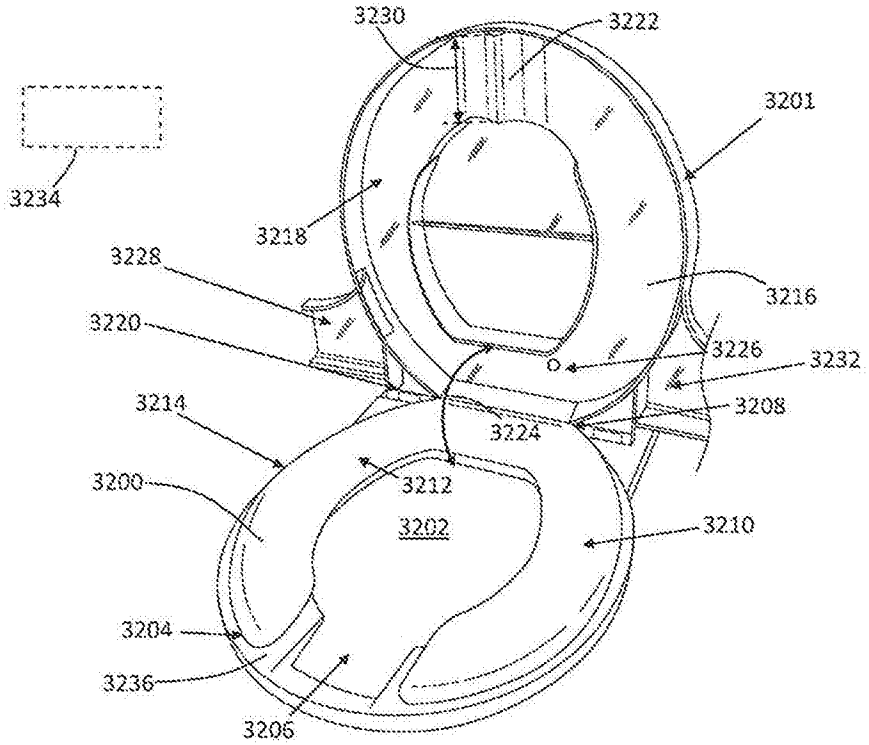
FIG. 32 is a perspective view of a toilet seat cover assembly in a second position along a cover translation path in accordance with another embodiment of the present invention.
Figure 33:
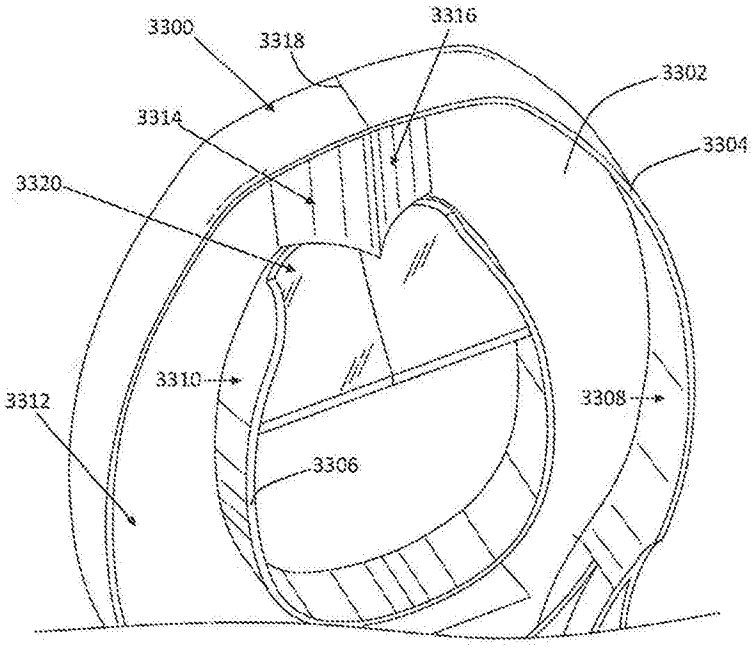
FIG. 33 is an isometric bottom view of an upper portion of a toilet seat cover assembly in accordance with yet another embodiment of the present invention, showing an air deflector of the toilet seat cover assembly.
Figure 34:
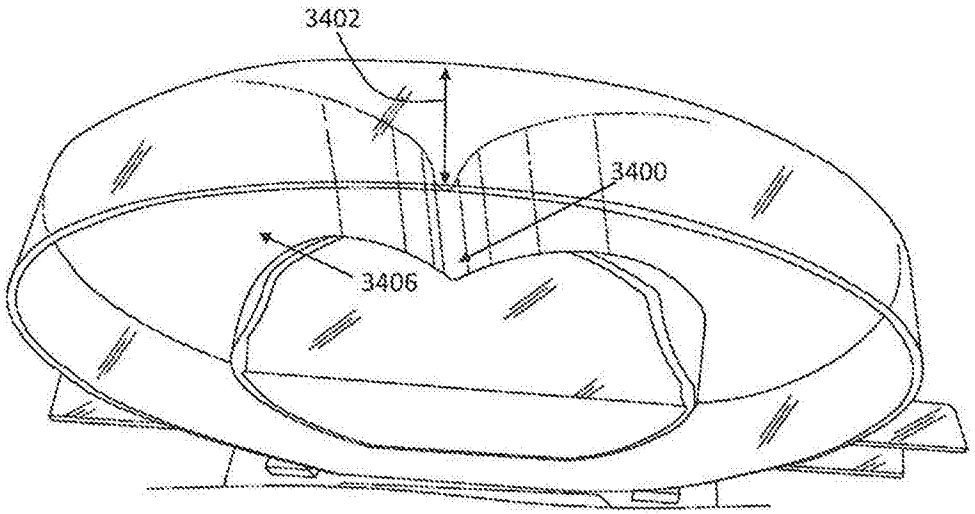
FIG. 34 is another isometric view of a toilet seat cover assembly in accordance with the present invention, showing the air deflector of the toilet seat cover assembly.
Figure 35:
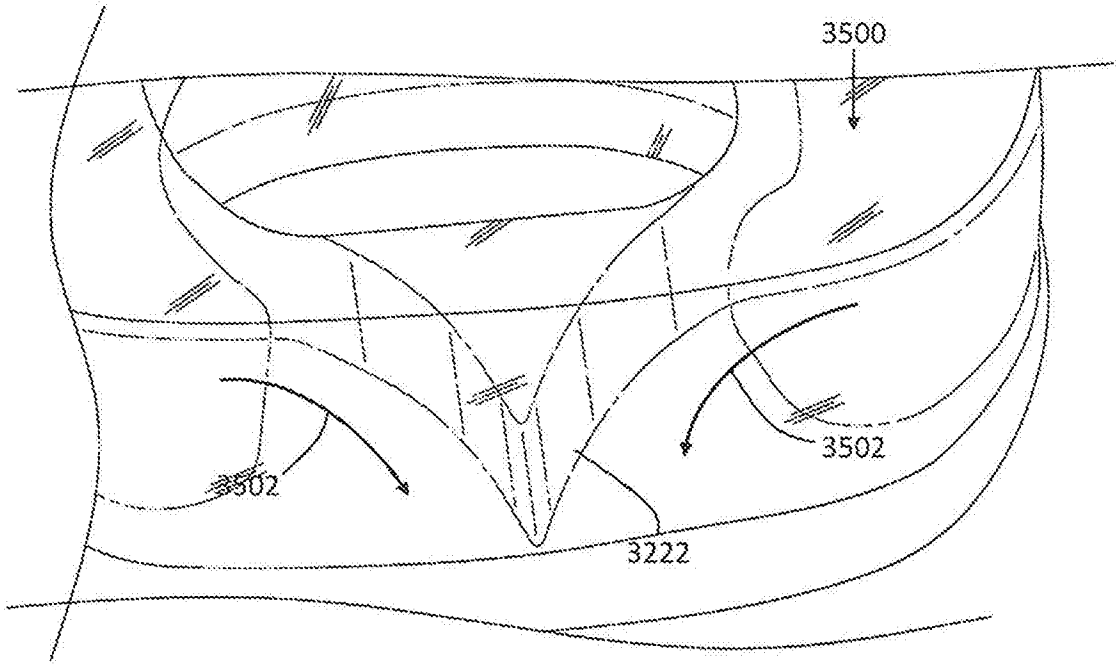
FIG. 35 is another isometric view of the air deflector of in a toilet seat cover assembly of the present invention and with the toilet seat cover assembly in a first position along the cover translation path.
Figure 36:
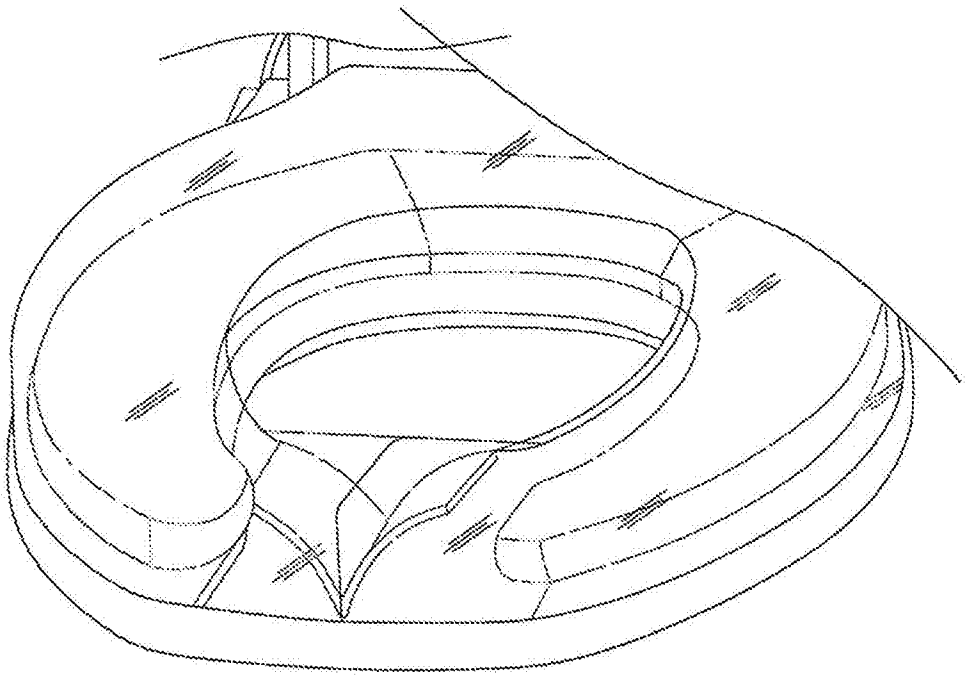
FIG. 36 is a perspective view of the toilet seat cover assembly in the first position along the cover translation path.

With reference to FIGS. 32-36, another embodiment of the present invention is shown. The embodiment shown in FIGS. 32-36 discloses and includes many of the same features and functionality discussed above. To that end, some of the features and components associated with said embodiment may not be discussed and/or may be excluded in FIGS. 32-36 for brevity. Like the previously described embodiments, the toilet seat cleaning assembly 3201 may be utilized in connection with a toilet having a toilet bowl and a toilet seat 3200 coupled to the toilet bowl. The toilet seat 3200 defines a center aperture 3202 and including a front end 3204, a back end 3208, a top surface 3210, an inner circumferential surface 3212, and an outer circumferential surface 3214. The assembly 3201 depicted in FIGS. 32-36 is extremely beneficial in toilet seat configurations with the front end 3204 defining a distal spatial discontinuity 3206 (as shown in FIG. 32). Said another way, the distal spatial discontinuity 3206 is a physical opening between two distal ends of the toilet seat 3200. However, the assembly 3201 may also work with toilet seat configurations without the front end 3204 defining a distal spatial discontinuity 3206.

The assembly 3201 includes a cover 3216 with an inner surface 3218 and an outer surface 3500 opposing the inner surface 3218. The cover 3216 includes a back end 3220, a front end 3300, an upper wall 3302 flanked by an outer sidewall 3304 and an inner sidewall 3306, wherein both the outer and inner sidewalls 3304, 3306 oppose one another, extend downwardly from the upper wall 3302, and have inner surfaces 3308, 3310 defining a fluid transport conduit 3312. Beneficially, the cover 3216 also includes an air deflector 3222 defining a portion of the upper wall 3302 of the cover 3216 and may be disposed proximal to the front end 3300 of the cover 3216. Said another way, the air deflector 3222 may be, and is preferably, directly adjacent to and/or directly coupled to the front end 3300 of the cover 3216. Alternatively, the air deflector 3222 may be offset a distance, e.g., less than approximately 1-2 inches, from the front end 3300 of the cover 3216. The air deflector 3222 includes two opposing surfaces 3314, 3316 converging together and extending downwardly away from the upper wall 3302 of the cover in order to direct incoming fluid from each respective side of the toilet seat 3200 to the toilet bowl, the distal spatial discontinuity 3206, and/or the discharge aperture 3320, which may be a singularly defined or "single aperture" defined by the cover 3216, namely the inner sidewall of the cover 3216.

Also like the above-described embodiments, the cover assembly 3201 may include a first position (FIGS. 35-36) and a second position (FIG. 32-34) along a cover translation path (represented and exemplified with an arrow 3224). The first position may include the cover surrounding the toilet seat 3200. The first position may also include the inner surface 3308 of the outer sidewall 3304 continuously contouring the outer circumference surface 3214 of the toilet seat 3200 from the back end 3208 of the toilet seat 3200 and toward the front end 3204 of the toilet seat 3200. The first position may include the inner surface 3310 of the inner sidewall continuously contouring the inner circumference surface 3212 of the toilet seat 3200 from the back end 3208 of the toilet seat 3200 toward the front end 3204 of the toilet seat 3200. Additionally, the first position may include the two opposing surfaces 3314, 3316 of the air deflector 3222 converging in an orientation toward the distal spatial discontinuity 3206 disposed at the front end 3204 of the toilet seat 3200.

The cover 3216 may also define at least one liquid aperture 3226 fluidly coupled to the fluid transport conduit 3312 and define at least one gas aperture 3228 fluidly coupled to the fluid transport conduit 3312. In some embodiments, like the previous embodiments, the at least one liquid aperture 3226 and the at least one gas aperture 3228 are the same, i.e., formed and defined by the same portion of the cover 3216. The fluid transport conduit 3312, when the cover 3216 is in the first position, may span from the back end 3208 of the toilet seat 3200, to the front end of the toilet seat 3200, and may terminate at the distal spatial discontinuity 3206 disposed at the front end 3204 of the toilet seat 3200.

The toilet seat cleaning assembly may also include, like described above, an electrical system (schematically depicted as numeral 3234) operably configured, when the cover 3200 is in the first position, to cause a liquid matter, from a liquid source, to discharge, through the at least one liquid aperture 3226, onto a portion of the top surface 3210 of the toilet seat 3200 and an induced flow of gaseous matter, from a gas source, to discharge, through the at least one gas aperture 3228, at a speed sufficient to transport the liquid matter through the fluid transport conduit 3312, on the top surface 3210 of toilet seat 3200, and through the distal spatial discontinuity 3206 disposed at the front end 3204 of the toilet seat 3200. An exemplary path of the fluid transportation caused by the air deflector 3222 can be best seen in FIG. 35 with arrows 3502. In one embodiment, the fluid directed by the air deflector 3222 goes directly into the toilet bowl. In other embodiments, the fluid directed by the air deflector 3222 may be directed to a bottom portion 3236 of the cover assembly 3201 that further effectuates transfer of the fluid to the toilet bowl. To that end, the bottom portion 3236 of the cover assembly 3201 may be angled and configured to facilitate in effectuating transfer of the fluid to the toilet bowl (as described above and depicted in the figures).

To enable effective control of the fluid transported within the cover assembly, the deflector 3222 spans from the outer sidewall 3304 to the inner sidewall 3306 in a longitudinal direction to define an air deflector length 3230. The two opposing surfaces 3314, 3316 of the air deflector 3222 may then converge to a common end point 3402, wherein the common end point is disposed a uniform distance 3402 from the upper wall 3306 along the air deflector length 3230. Said another way, the air deflector 3222 may extend a distance 3402, e.g., 1-3 inches, away from the upper wall 3302 uniformly as it spans longitudinally.

In some embodiments, the air deflector 3222 may define a center axis 3318 spanning through a centroid of the air deflector 3222 to bisect the air deflector 3222 into two portions about the center axis 3318. Each of two portions may have one of the two opposing surfaces 3314, 3316 disposed thereon and will be symmetrically configured with respect to one another to have an equal amount of direction for each side of the toilet seat as it terminates into the air deflector 3222. To further direct flow of the incoming fluid, the two opposing surfaces 3314, of the air deflector 3222 may be of an arcuate shape (whether in whole, or in part). Additionally, the air deflector 3222 may be disposed on the upper wall 3306 of the cover 3216 and at the front end 3300 of the cover 3216 and may form part of the inner surface 3308 of the outer sidewall 3304. The opposing surfaces 3314, 3316 of the air deflector 3222 may also be described as converging together away from the inner surface 3308 of the outer sidewall 3304.

In some embodiments, as discussed above, the inner surface 3310 of the inner sidewall continuously contours the inner circumference surface 3212 of the toilet seat 3200 from the back end 3208 of the toilet seat 3200 toward the front end 3204 of the toilet seat 3200 to define a discharge aperture 3320 disposed at the front end 3204 of the toilet seat 3200. Further, the cover may also include two gas apertures 3228, 3232 defined thereon and disposed at the back end 3220 of the cover 3216, the two gas apertures 3228, 3232 opposing one another and each respectively oriented toward different side portions of the fluid transport conduit 3312.

As such, an automatic toilet seat-cleaning assembly has been disclosed that is operable to clean and/or disinfect the top surface of the toilet seat before use by the user in an effective, energy- and cost-efficient, and clean manner.

What is claimed is:

1. In combination with a toilet having a toilet bowl and a toilet seat coupled to the toilet bowl, the toilet seat defining a center aperture and including a front end defining a distal spatial discontinuity, a back end, a top surface, an inner circumferential surface, and an outer circumferential surface, the improvement comprising;

a cover with an inner surface and an outer surface opposing the inner surface, the cover:

including a back end, a front end, an upper wall flanked by an outer sidewall and an inner sidewall, both the outer and inner sidewalls opposing one another, extending downwardly from the upper wall, and having inner surfaces defining a fluid transport conduit;

including an air deflector defining a portion of the upper wall of the cover and disposed proximal to the front end of the cover, the air deflector including two opposing surfaces converging together and extending downwardly away from the upper wall of the cover;

with a first position and a second position along a cover translation path, the first position including:

the cover surrounding the toilet seat;

the inner surface of the outer sidewall continuously contouring the outer circumference surface of the toilet seat from the back end of the toilet seat and toward the front end of the toilet seat;

the inner surface of the inner sidewall continuously contouring the inner circumference surface of the toilet seat from the back end of the toilet seat toward the front end of the toilet seat; and the two opposing surfaces of the air deflector converging in an orientation toward the distal spatial discontinuity disposed at the front end of the toilet seat;

defining at least one liquid aperture fluidly coupled to the fluid transport conduit; and defining at least one gas aperture fluidly coupled to the fluid transport conduit, the fluid transport conduit, when the cover is in the first position, spanning from the back end of the toilet seat, to the front end of the toilet seat, and terminating at the distal spatial discontinuity disposed at the front end of the toilet seat; and an electrical system operably configured, when the cover is in the first position, to cause:

a liquid matter, from a liquid source, to discharge, through the at least one liquid aperture, onto a portion of the top surface of the toilet seat; and an induced flow of gaseous matter, from a gas source, to discharge, through the at least one gas aperture, at a speed sufficient to transport the liquid matter through the fluid transport conduit, on the top surface of toilet seat, and through the distal spatial discontinuity disposed at the front end of the toilet seat.

2. The improvement according to claim 1, wherein the air deflector spans from the outer sidewall to the inner sidewall in a longitudinal direction to define an air deflector length.

3. The improvement according to claim 2, wherein the two opposing surfaces of the air deflector converge to a common end point, the common end point disposed a uniform distance from the upper wall along the air deflector length.

4. The improvement according to claim 1, wherein the air deflector further defines a center axis spanning through a centroid of the air deflector and bisecting the air deflector into two portions about the center axis, with each of two portions having one of the two opposing surfaces disposed thereon and symmetrically configured with respect to one another.

5. The improvement according to claim 1, wherein the two opposing surfaces of the air deflector are of an arcuate shape.

6. The improvement according to claim 1, wherein the air deflector is disposed on the upper wall of the cover and at the front end of the cover and forms part of the inner surface of the outer sidewall.

7. The improvement according to claim 1, wherein the two opposing surfaces of the air deflector converge together away from the inner surface of the outer sidewall.

8. The improvement according to claim 1, wherein the first position further comprises:

the inner surface of the inner sidewall continuously contouring the inner circumference surface of the toilet seat from the back end of the toilet seat toward the front end of the toilet seat to define a discharge aperture disposed at the front end of the toilet seat.

9. The improvement according to claim 1, wherein the cover further comprises:

two gas apertures defined thereon and disposed at the back end of the cover, the two gas apertures opposing one another and each respectively oriented toward different side portions of the fluid transport conduit.

10. The improvement according to claim 9, wherein the cover further comprises:

a center air deflector extending downwardly from the upper wall at the back end of the cover to partition the fluid transport conduit into a first side fluid transport conduit and a second side fluid transport conduit, the first and second side fluid transport conduits respectively disposed over one of the side top surface of the toilet seat when the cover is in the first position along the cover translation path.

11. The improvement according to claim 10, wherein the first and second side fluid transport conduits respectively taper in width at or proximal to the front end of the cover.

12. The improvement according to claim 11, wherein the discharge aperture is a single aperture.

13. The improvement according to claim 12, wherein a portion of the inner surface of the inner sidewall continuously contours the inner circumference surface of the toilet seat from the back end of the toilet seat to the front end, wherein the single discharge aperture is interposed by the portion of the inner sidewall and the upper wall of the cover.

14. The improvement according to claim 13, further comprising an upper hood coupled to the upper wall of the cover and having an inner surface extending from the single discharge aperture and oriented toward the toilet bowl when the cover is in the first position along the cover translation path.

15. The improvement according to claim 14, wherein the two opposing surfaces of the air deflector converge together to form an air deflector joint substantially aligned with a discharge aperture axis defined by a centroid of the discharge aperture.

16. A toilet seat cleaning assembly comprising a cover:

having an inner surface and an outer surface opposing the inner surface, the cover including a back end, a front end, an upper wall flanked by an outer sidewall operably configured to contour an outer circumference surface of a toilet seat and an inner sidewall operably configured to contour an inner circumference surface of the toilet seat, both the outer and inner sidewalls opposing one another, extending downwardly from the upper wall, and having inner surfaces defining a fluid transport conduit;

having an air deflector defining a portion of the upper wall of the cover and disposed proximal to the front end of the cover, the air deflector including two opposing surfaces converging together and extending downwardly away from the upper wall of the cover and spanning from the outer sidewall to the inner sidewall in a longitudinal direction to define an air deflector length, wherein the two opposing surfaces of the air deflector converge to a common end point disposed a uniform distance from the upper wall along the air deflector length;

defining at least one liquid aperture fluidly coupled to the fluid transport conduit; and defining at least one gas aperture fluidly coupled to the fluid transport conduit spanning from the back end of the cover to the front end of the cover.

17. The toilet seat cleaning assembly according to claim 16, further comprising an electrical system operably configured to cause:

a liquid matter, from a liquid source, to discharge, through the at least one liquid aperture; and an induced flow of gaseous matter, from a gas source, to discharge, through the at least one gas aperture.

18. The toilet seat cleaning assembly according to claim 16, wherein the air deflector further defines a center axis spanning through a centroid of the air deflector and bisecting the air deflector into two portions about the center axis, with each of two portions having one of the two opposing surfaces disposed thereon and symmetrically configured with respect to one another.

19. The toilet seat cleaning assembly according to claim 18, wherein the two opposing surfaces of the air deflector are of an arcuate shape.

* * * * *